US009649751B2

(12) United States Patent
Huang

(10) Patent No.: US 9,649,751 B2
(45) Date of Patent: May 16, 2017

(54) REVERSIBLE RATCHET WRENCH WITH A SMALLER ROTATIONAL ANGLE

(71) Applicant: Chih-Min Chang, Changhua County (TW)

(72) Inventor: Ping-Wen Huang, Taichung (TW)

(73) Assignee: Chih-Min Chang, Changhua County (TW)

( * ) Notice: Subject to any disclaimer, the term of this patent is extended or adjusted under 35 U.S.C. 154(b) by 327 days.

(21) Appl. No.: 14/470,986

(22) Filed: Aug. 28, 2014

(65) Prior Publication Data

US 2015/0059533 A1 Mar. 5, 2015

(30) Foreign Application Priority Data

Aug. 30, 2013 (TW) ..... 102131313 A

(51) Int. Cl.
*B25B 13/46* (2006.01)

(52) U.S. Cl.
CPC ..... *B25B 13/463* (2013.01)

(58) Field of Classification Search
CPC ..... B25B 13/463; B25B 13/481
See application file for complete search history.

(56) References Cited

U.S. PATENT DOCUMENTS 2,978,081 A * 4/1961 Lundin ..... B25B 13/463 192/43.1
5,782,147 A * 7/1998 Chaconas ..... B25B 13/463 192/43.1
9,120,211 B2 * 9/2015 Huang ..... B25B 13/463
2013/0228049 A1 * 9/2013 Shen ..... B25B 13/463 81/63.1
2013/0269488 A1 * 10/2013 Huang ..... B25B 13/481 81/60

FOREIGN PATENT DOCUMENTS

TW M431776 U 6/2012

* cited by examiner

*Primary Examiner* — David B Thomas
(74) *Attorney, Agent, or Firm* — Muncy, Geissler, Olds & Lowe, P.C.

(57) ABSTRACT

A reversible ratchet wrench includes a driving member received in a receiving space of a body, rotatable about a rotational axis relative to the body, and having an annular toothed portion. First and second pawls are aligned with each other along an axis parallel to the rotational axis and are alternatively disposed. The first and second pawls are received in a compartment in the body. One of the first and second pawls selectively meshes with the driving member. Each of the first and second pawls includes a ratcheting portion. The ratcheting portions selectively mesh with the annular toothed portion. A control member is pivotably received in the compartment. An end of the control member presses against the first and second pawls when the reversible ratchet wrench is switched between first and second positions. The control member can be actuated to move the first and second pawls.

14 Claims, 24 Drawing Sheets

REVERSIBLE RATCHET WRENCH WITH A SMALLER ROTATIONAL ANGLE

BACKGROUND OF THE INVENTION

The present invention relates to a ratchet wrench and, more particularly, to a reversible ratchet wrench using two pawls alternatively meshed with a driving member to permit a smaller rotational angle.

Taiwan Utility Model No. M431776 discloses a reversible ratchet wrench including a handle, a head, a driving member, a switch button, and first and second pawls. The head includes first and second compartments intercommunicated with each other at an intermediate section of the head. The driving member includes an annular driving toothed portion received in the first compartment and a driving end. The switch button is received in the second compartment and is movable between first and second positions. The switch button includes two elastic elements and two pressing rods. Each of the first and second pawls includes a plurality of ratchet teeth for meshing with the annular driving toothed portion. The first and second pawls are superimposed on each other and are received in the intermediate section. A side of each of the first and second pawls adjacent to the switch button includes a recessed portion. The switch button urges the first and second pawls to press against or mesh with the annular driving toothed portion. The arrangement of the ratchet teeth of the first pawl is different from that of the ratchet teeth of the second pawl, such that one of the first and second pawls meshes with the annular driving toothed portion when the other of the first and second pawls presses against the annular driving toothed portion. When the switch button is in a first position, the switch button biases the first and second pawls to press against a side of an inner wall of the intermediate section of the head, permitting the reversible ratchet wrench to rotate freely in a first direction. On the other head, when the switch button is in a second position, the switch button biases the first and second pawls to press against the other side of the inner wall of the intermediate section of the head, permitting the reversible ratchet wrench to rotate freely in a second direction reverse to the first direction.

However, when the switch button is pivoted to move the angular position of the two pressing rods, the two pressing rods are biased by the two elastic elements to press against the recessed portions of the first and second pawls, and the pressing rods are slideable in the recessed portions. Specifically, the first and second paws can be driven to achieve the direction switching effect after the locations of the recessed portions pressed by the pressing rods are changed. After a long period of time of use, dust, oil, or even scraps resulting from friction between the first and second pawls accumulate in the head, adversely affecting smooth movement of the first and second pawls in the head such that the direction switching effect cannot be achieved even though the switch button is pivoted.

A reversible ratchet wrench with a smaller rotational angle is provided to mitigate and/or obviate the above disadvantages of the prior art.

BRIEF SUMMARY OF THE INVENTION

A reversible ratchet wrench according to the present invention includes a body defining a rotational axis. The body includes a receiving space and a compartment intercommunicated with the receiving space. The compartment is located on a side of the receiving space in a radial direction perpendicular to the rotational axis. A driving member is received in the receiving space of the body. The driving member is rotatable about the rotational axis relative to the body. The driving member includes an annular toothed portion surrounding the rotational axis. A ratcheting device includes a first pawl and a second pawl. The first pawl and the second pawl are aligned with each other along an axis parallel to the rotational axis and are alternatively disposed. The first pawl and the second pawl are received in the compartment. One of the first pawl and the second pawl selectively meshes with the driving member. The first pawl includes a side facing the driving member and having a first ratcheting portion. The second pawl includes a side facing the driving member and having a second ratcheting portion. The first ratcheting portion and the second ratcheting portion selectively mesh with the annular toothed portion of the driving member. A switching device defines a pivotal axis parallel to the rotational axis. The pivotal axis is spaced from the first pawl and the second pawl. The switching device includes a control member received in the compartment and is pivotable about the pivotal axis. An end of the control member presses against the first pawl and the second pawl when the reversible ratchet wrench is switched between a first position and a second position. The control member is capable of moving the first pawl and the second pawl. A push device is mounted between the ratcheting device and the switching device. The push device biases the first pawl and the second pawl to mesh with the annular toothed portion.

The first pawl can include a first protrusion extending along the axis parallel to the rotational axis. The second pawl can include a second protrusion extending along the axis parallel to the rotational axis. The control member can include at least one control arm located adjacent to the ratcheting device. The at least one control arm extends in a radial direction perpendicular to the pivotal axis. The at least one control arm includes a sliding groove extending in the radial direction perpendicular to the pivotal axis. The first protrusion is received in the sliding groove. The first pawl is slideable relative to the control member in the radial direction perpendicular to the pivotal axis. The first pawl is pivotable relative to the control member.

In an embodiment, the at least one control arm includes two control arms. Each control arm includes the sliding groove. The first protrusion is located on a surface of the first pawl distant to the second pawl. The second protrusion is located on a surface of the second pawl distant to the first pawl. The first protrusion and the second protrusion are respectively and slideably received in the sliding grooves of the two control arms. The second pawl is slideable relative to the control member in the radial direction perpendicular to the pivotal axis. The second pawl is pivotable relative to the control member. Each sliding groove includes two lateral sides, with each of the two lateral sides having an abutment face. The abutment faces of each sliding groove are located on two sides of one of the first protrusion and the second protrusion.

Each of the first protrusion and the second protrusion can be cylindrical.

The push device can include first and second elastic elements respectively received in the sliding grooves. The first elastic element has two ends respectively abutting the control member and the first protrusion of the first pawl. The second elastic element has two ends respectively abutting the control member and the second protrusion of the second pawl. The first elastic element biases the first pawl away from the control member. The second elastic element biases the second pawl away from the control member.

The first ratcheting portion can have a plurality of first ratchet teeth and a plurality of second ratchet teeth respectively on two ends of the first ratcheting portion. The plurality of first ratchet teeth and the plurality of second ratchet teeth are not located on the same plane. The second ratcheting portion can have a plurality of third ratchet teeth and a plurality of fourth ratchet teeth respectively on two ends of the second ratcheting portion. The plurality of third ratchet teeth and the plurality of fourth ratchet teeth are not located on the same plane. The plurality of first ratchet teeth or the plurality of third ratchet teeth meshes with the annular toothed portion when the first pawl and the second pawl are in the first position. The plurality of second ratchet teeth or the plurality of fourth ratchet teeth meshes with the annular toothed portion when the first pawl and the second pawl are in the second position.

The annular toothed portion can include a plurality of annularly arranged first teeth and a plurality of annularly arranged second teeth. The plurality of annularly arranged first teeth and the plurality of annularly arranged second teeth are aligned with each other along the rotational axis and are alternatively disposed. The first pawl and the second pawl have an identical shape. The plurality of first ratchet teeth or the plurality of second ratchet teeth of the first ratcheting portion selectively meshes with the plurality of annularly arranged first teeth. The plurality of third ratchet teeth or the plurality of fourth ratchet teeth of the second ratcheting portion selectively meshes with the plurality of annularly arranged second teeth.

The driving member can further include an annular groove defined in the annular toothed portion. The first pawl includes a first engagement ledge extending towards the driving member. The first engagement ledge is received in the annular groove.

The second pawl can include a second engagement ledge extending towards the driving member. The second engagement ledge is received in the annular groove. The annular groove is located between the first pawl and the second pawl. The first pawl and the second pawl respectively mesh with two sides of the annular toothed portion. The first engagement ledge is formed on another surface of the first pawl adjacent to the second pawl. The second engagement ledge is formed on another surface of the second pawl adjacent to the first pawl.

In an embodiment, the receiving space has a first diameter. The body includes a coupling ledge and a coupling groove in the receiving space. The coupling ledge and the coupling groove are located at two ends of the receiving space along the rotational axis. A retainer ring is received in the coupling groove. The coupling ledge has a second diameter. The retainer ring has a third diameter. The second and third diameters are smaller than the first diameter. The annular toothed portion has a maximum diameter smaller than the first diameter and larger than the second and third diameters. The driving member includes two sides respectively abutting the coupling ledge and the retainer ring.

The body can further include an operative portion having a through-hole. The through-hole extends along a first axis coaxial to the pivotal axis and intercommunicates the compartment with the outside. The switching device further includes a switch button mounted to the operative portion. The control member includes a first transmission portion. The switch button includes a second transmission portion. The first transmission portion and the second transmission portion are coupled to each other by extending through the through-hole. The switch button is operable to actuate the control member to cause joint pivotal movement of the switch button and the control member about the pivotal axis.

In an embodiment, the first transmission portion includes a transmission hole, and the second transmission portion includes a transmission rod extending through the through-hole into the transmission hole.

The operative portion can further include a receptacle, an elastic element, and a positioning member. The receptacle is defined in a side of the body and extends along a second axis parallel to the longitudinal axis. The first axis is located between the second axis and the longitudinal axis. The elastic element and the positioning member are received in the receptacle. The elastic element includes two ends respectively abutting an end wall of the receptacle and the positioning member. The switch button includes a bottom side having first and second positioning grooves and facing the side of the body. The positioning member is biased by the elastic element to selectively engage with one of the first and second positioning grooves.

Other objectives, advantages, and novel features of the present invention will become clearer in light of the following detailed description described in connection with the accompanying drawings.

DETAILED DESCRIPTION OF THE INVENTION

Figure 1:
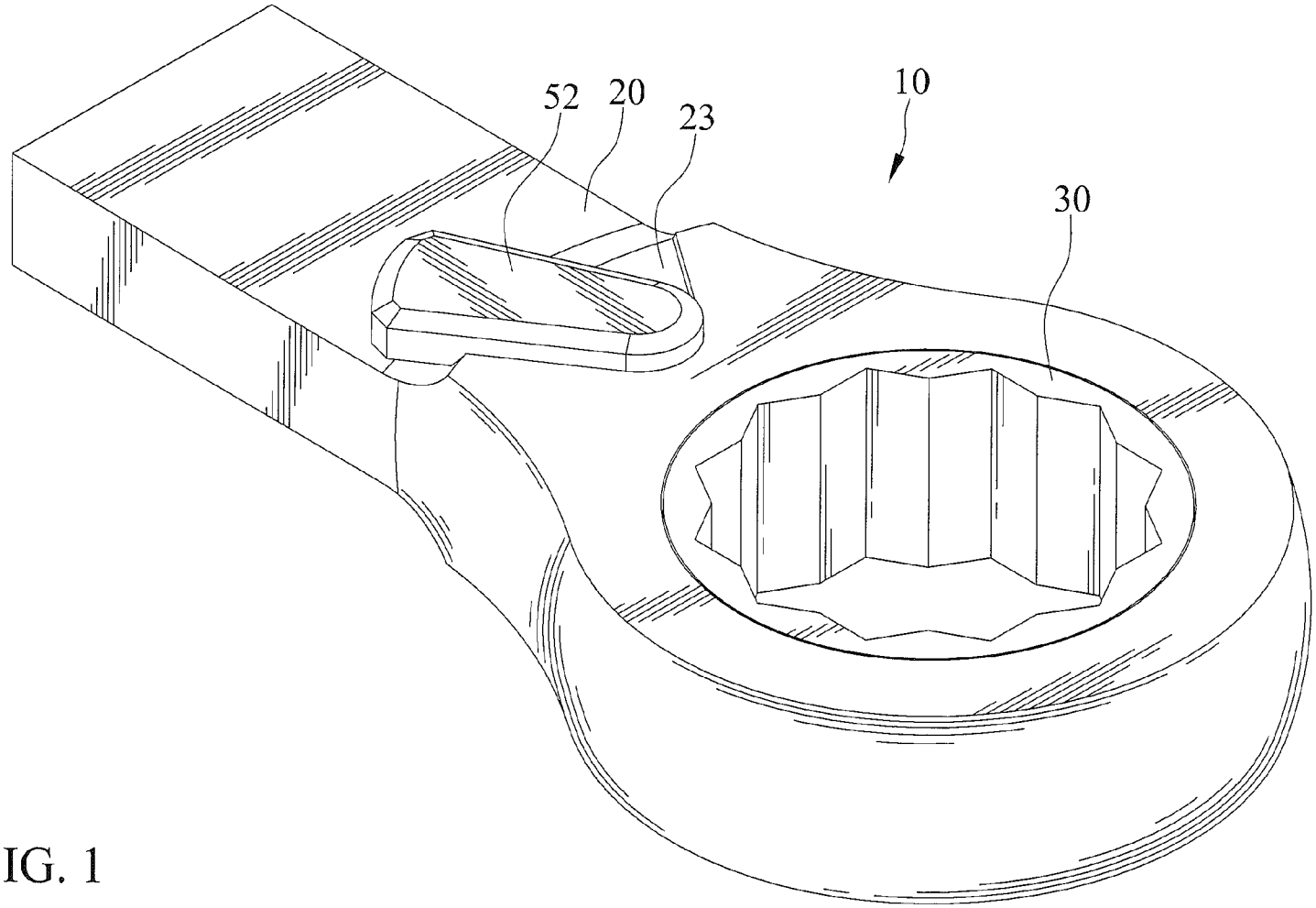
FIG. 1 is a perspective view of a reversible ratchet wrench with a smaller rotational angle of a first embodiment according to the present invention.
Figure 2:
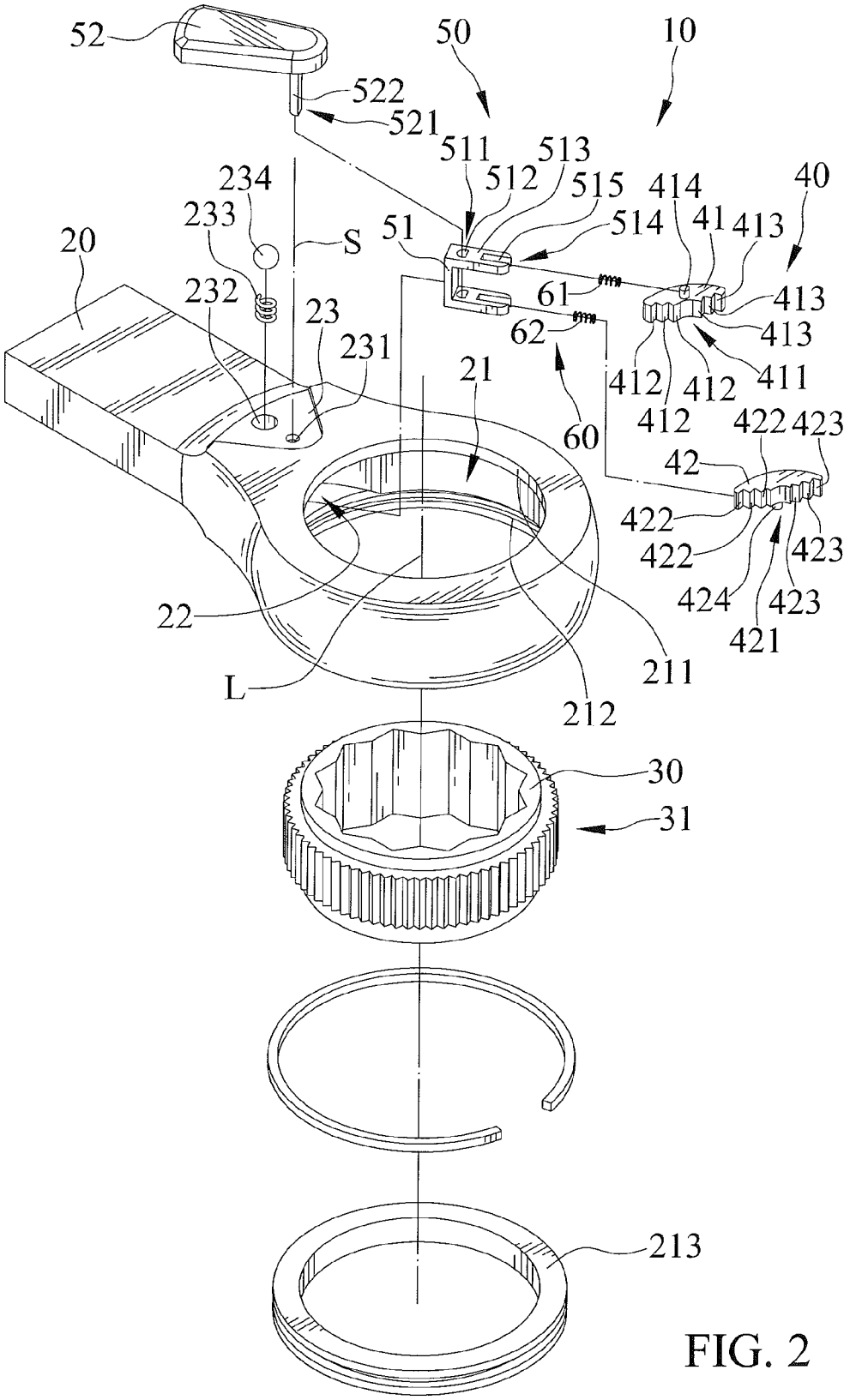
FIG. 2 is an exploded, perspective view of the reversible ratchet wrench of FIG. 1.
Figure 3:
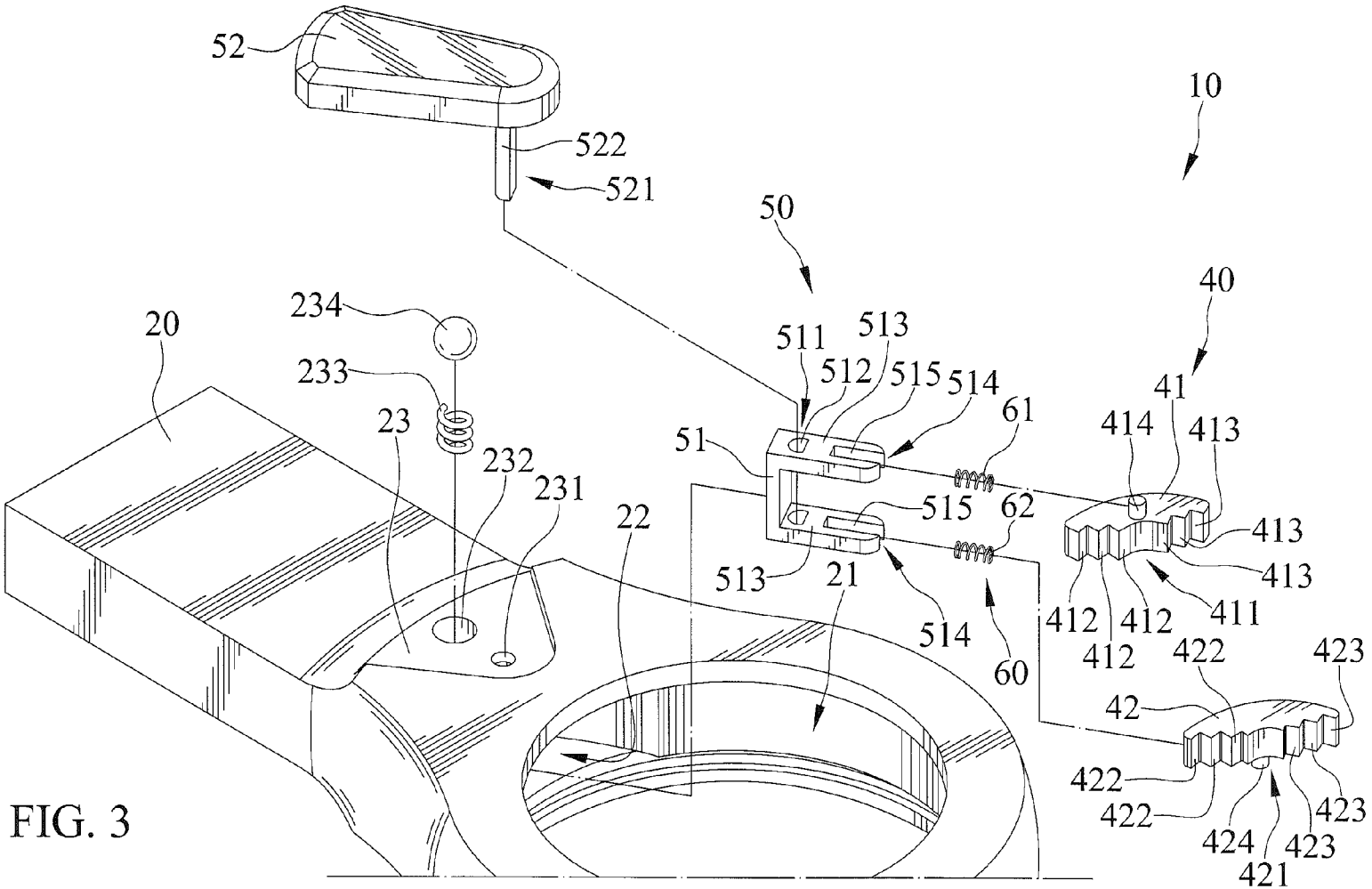
FIG. 3 is an enlarged, exploded, perspective view of a portion of the reversible ratchet wrench of FIG. 2.

FIGS. 1-11 show a reversible ratchet wrench 10 with a smaller rotational angle of a first embodiment according to the present invention. The reversible ratchet wrench 10 includes a body 20, a driving member 30, a ratcheting device 40, a switching device 50, and a push device 60.

The body 20 defines a rotational axis C and includes a receiving space 21 and a compartment 22 intercommunicated with the receiving space 21. The receiving space 21 extends through two sides of the body 20 along the longitudinal axis C. The compartment 22 is located in the body 22 and is located on a side of the receiving space 21 in a radial direction perpendicular to the rotational axis C.

Figure 5:
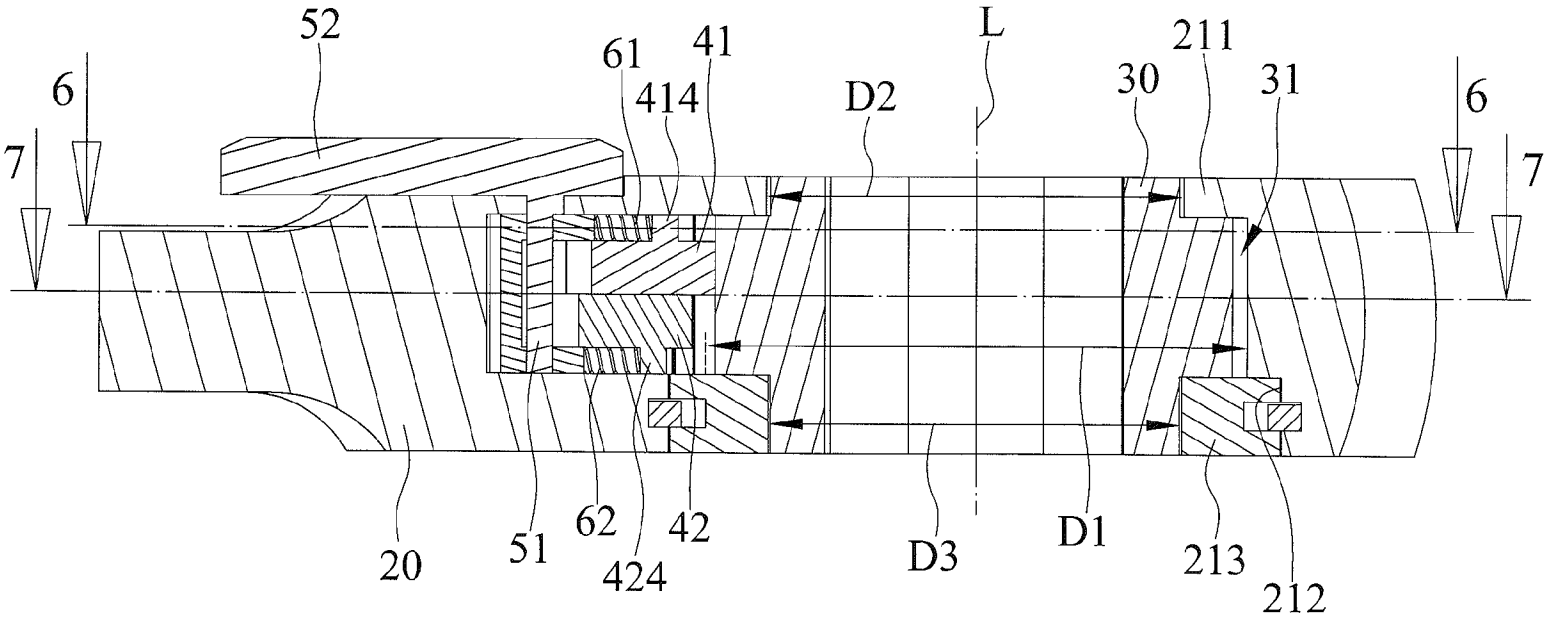
FIG. 5 is a cross sectional view taken along section line 5-5 of FIG. 4.
Figure 6:
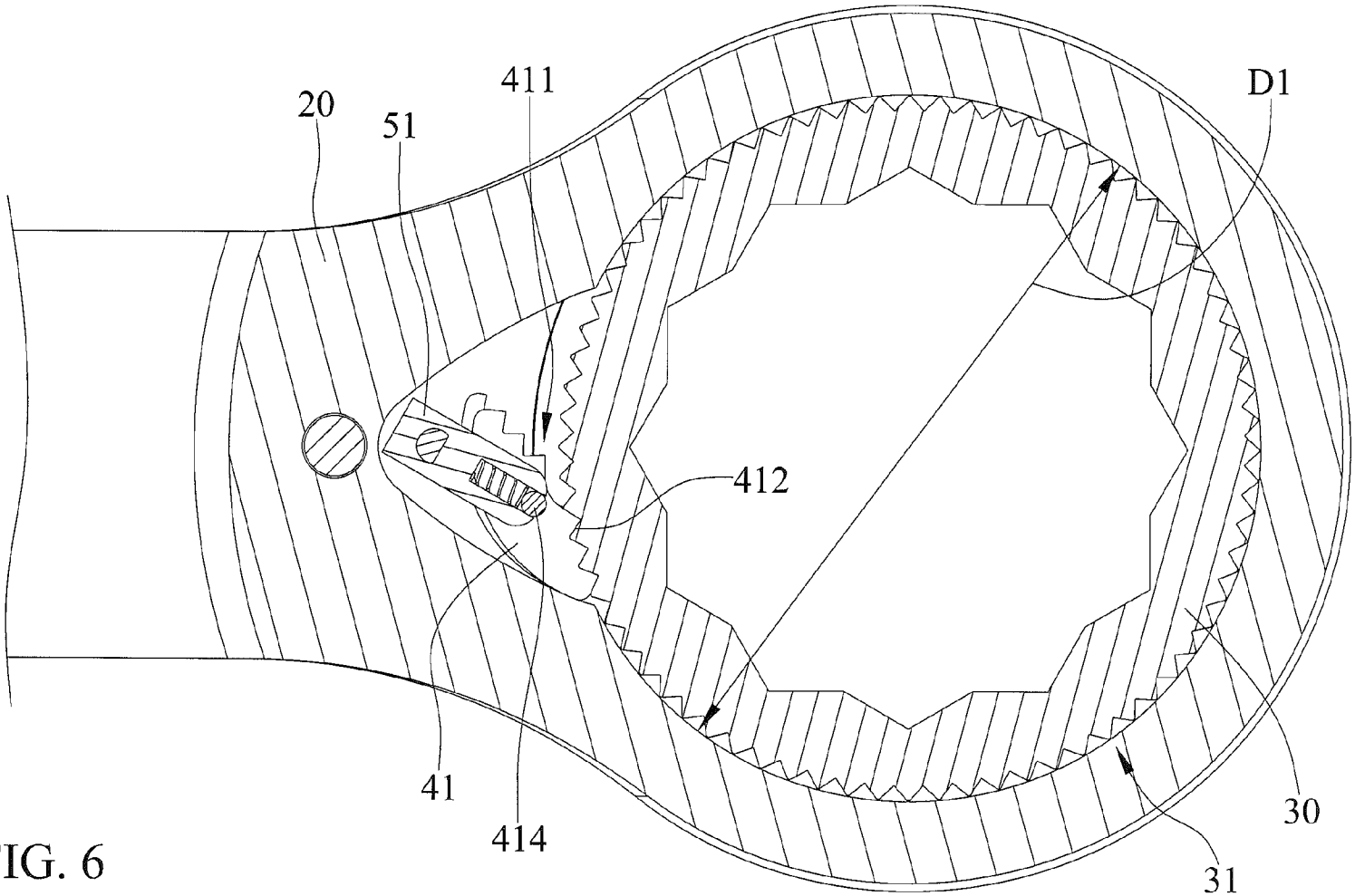
FIG. 6 is a cross sectional view taken along section line 6-6 of FIG. 5, illustrating a first pawl in a first position.
Figure 7:
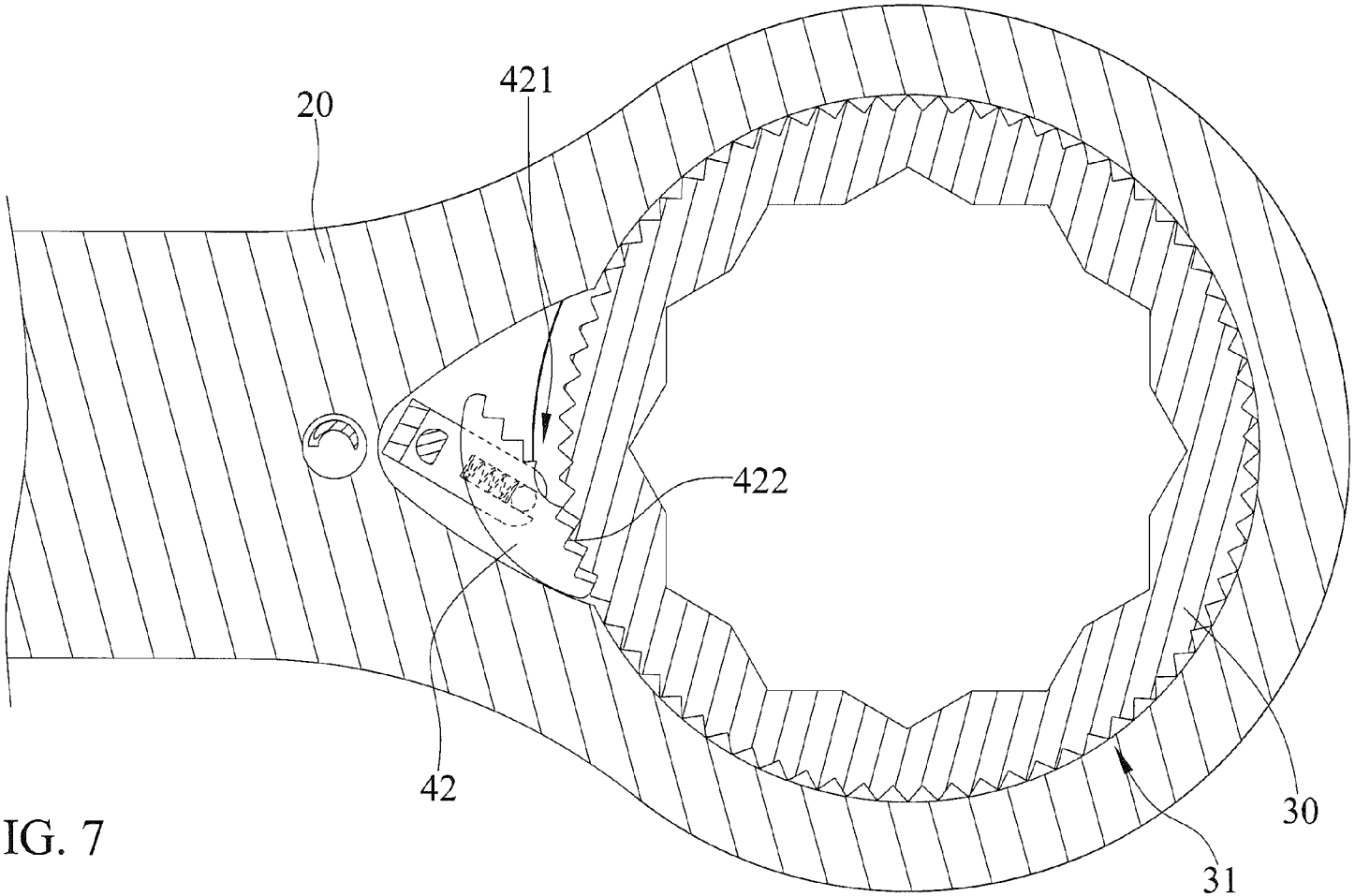
FIG. 7 is a cross sectional view taken along section line 7-7 of FIG. 5, illustrating a second pawl in a first position.
Figure 8:
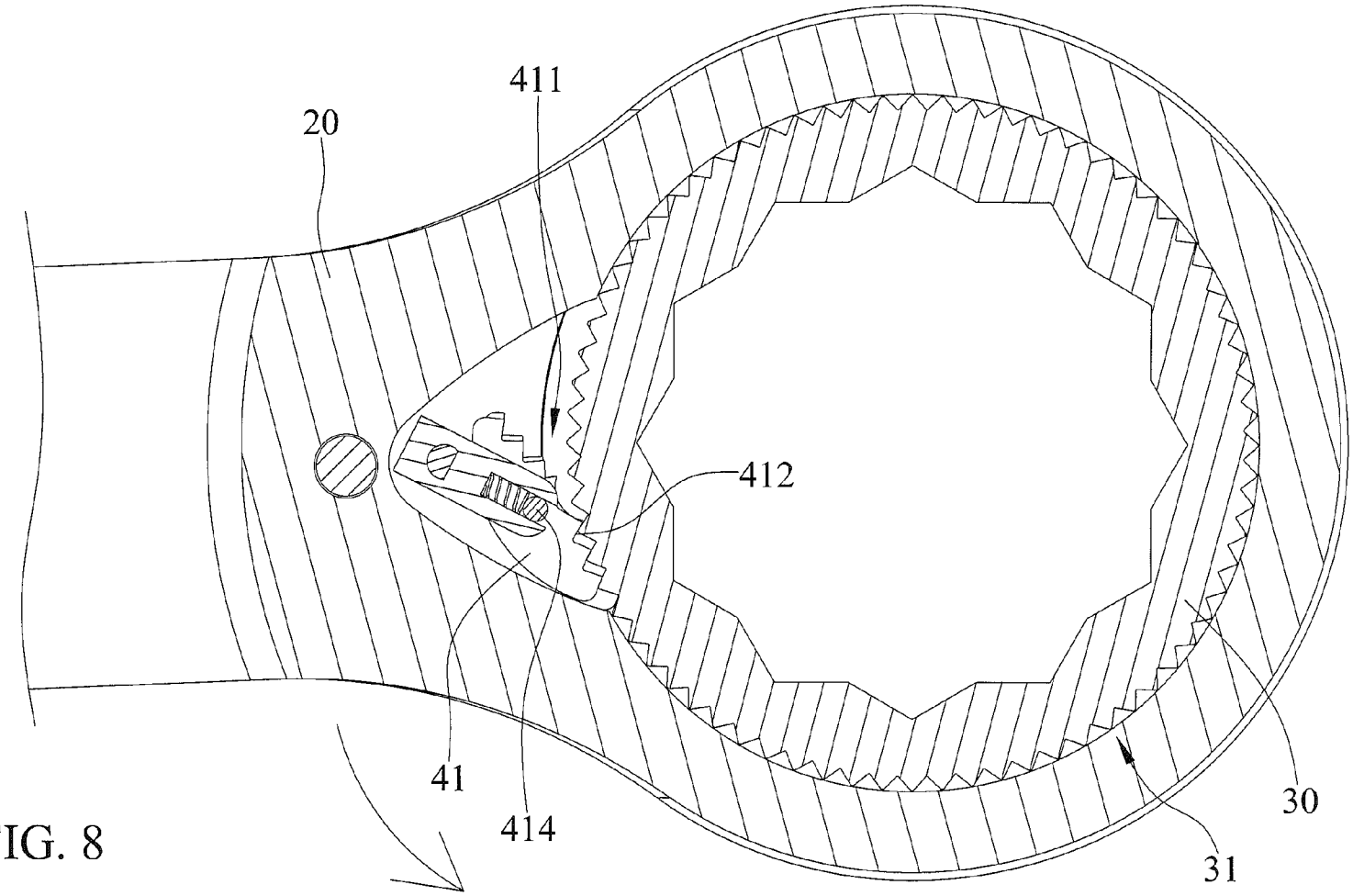
FIG. 8 is a view similar to FIG. 6, illustrating operation of the reversible ratchet wrench.
Figure 9:
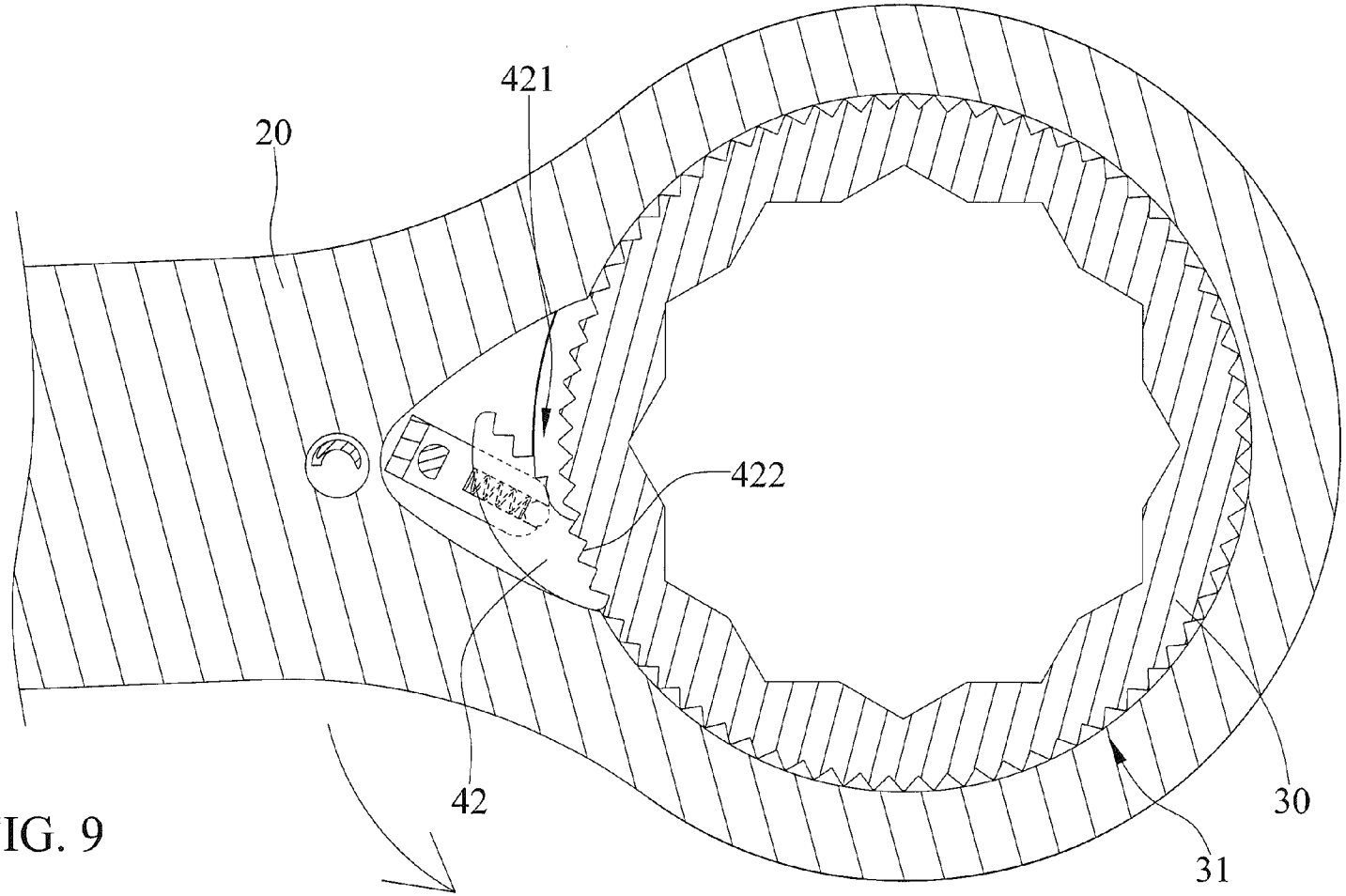
FIG. 9 is a view similar to FIG. 7, illustrating operation of the reversible ratchet wrench.

The receiving space 21 has a first diameter D1 (FIG. 5). The body 20 further includes a coupling ledge 211 and a coupling groove 212 in the receiving space 21. The coupling ledge 211 and the coupling groove 212 are located at two ends of the receiving space 21 along the rotational axis C. A retainer ring 213 is received in the coupling groove 212. The coupling ledge 211 has a second diameter D2 (FIG. 5). The retainer ring 213 has a third diameter D3 (FIG. 5). The second and third diameters D2 and D3 are smaller than the first diameter D1.

The body 20 further includes an operative portion 23 having a through-hole 231. The through-hole 231 extends along a first axis parallel to the rotational axis C and intercommunicates the compartment 22 with the outside. The operative portion 23 further includes a receptacle 232, an elastic element 233, and a positioning member 234. The receptacle 232 is defined in one of the two sides of the body 20 and extends along a second axis parallel to the longitudinal axis C. The first axis is located between the second axis and the longitudinal axis C. The elastic element 233 and the positioning member 234 are received in the receptacle 232. The elastic element 233 includes two ends respectively abutting an end wall of the receptacle 232 and the positioning member 234.

Figure 4:
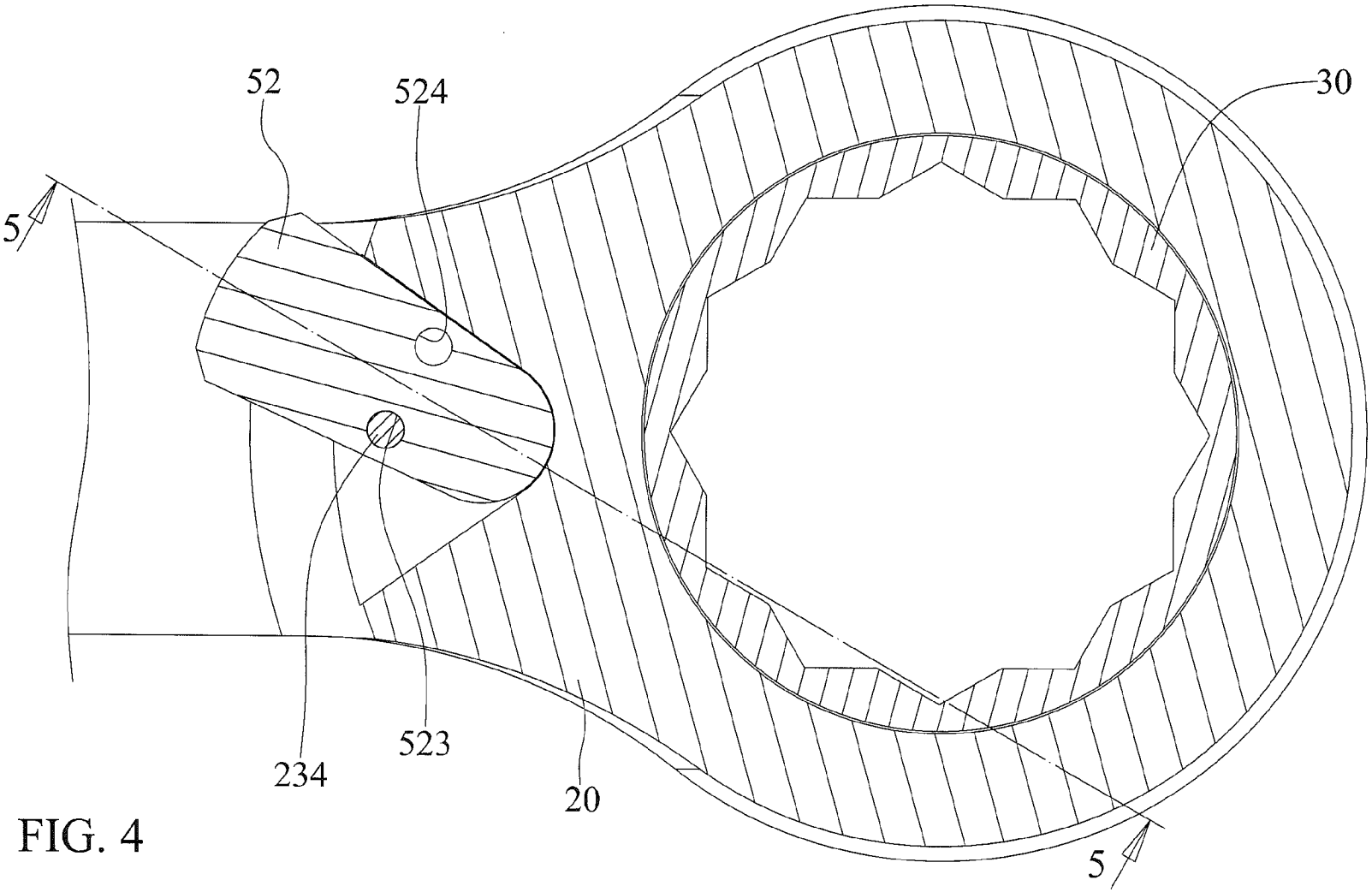
FIG. 4 is a cross sectional view of the reversible ratchet wrench of FIG. 1.

With reference to FIGS. 4 and 5, the driving member 30 is received in the receiving space 21 of the body 20 and is rotatable about the rotational axis C relative to the body 20. The driving member 30 includes an annular toothed portion 31 surrounding the rotational axis C. The annular toothed portion 31 has a maximum diameter smaller than the first diameter D1 and larger than the second and third diameters D2 and D3. Two sides of the driving member 30 respectively abut the coupling ledge 211 and the retainer ring 213.

The ratcheting device 40 includes a first pawl 41 and a second pawl 42. The first pawl 41 and the second pawl 42 are aligned with each other along an axis parallel to the rotational axis C, with the axis located between the first axis and the rotational axis C. The first pawl 41 and the second pawl 42 are received in the compartment 22. The first pawl 41 includes a side facing the driving member 30 and having a first ratcheting portion 411. The second pawl 42 includes a side facing the driving member 30 and having a second ratcheting portion 421. The first ratcheting portion 411 and the second ratcheting portion 421 selectively mesh with the annular toothed portion 31 of the driving member 30.

The first ratcheting portion 411 has a plurality of first ratchet teeth 412 and a plurality of second ratchet teeth 413 respectively on two ends of the first ratcheting portion 411. The first ratchet teeth 412 are aligned with each other. The second ratchet teeth 413 are arranged with each other. The first ratchet teeth 412 and the second ratchet teeth 413 are not located on the same plane. The second ratcheting portion 421 has a plurality of third ratchet teeth 422 and a plurality of fourth ratchet teeth 423 respectively on two ends of the second ratcheting portion 421. The third ratchet teeth 422 are aligned with each other. The fourth ratchet teeth 423 are arranged with each other. The third ratchet teeth 422 and the fourth ratchet teeth 423 are not located on the same plane.

The first pawl 41 includes a first protrusion 414 located on a surface of the first pawl 41 distant to the second pawl 42 and extending along the axis parallel to the rotational axis C. The second pawl 42 includes a second protrusion 424 located on a surface of the second pawl 42 distant to the first pawl 41 and extending along the axis parallel to the rotational axis C. Each of the first protrusion 414 and the second protrusion 424 is cylindrical.

The switching device 50 defines a pivotal axis S parallel to the rotational axis C and spaced from the first pawl 41 and the second pawl 42. Thus, the pivotal axis S does not pass through the first pawl 41 and the second pawl 42. The pivotal axis S is coaxial to the first axis along which the through-hole 231 extends.

The switching device 50 includes a control member 51 and a switch button 52. The control member 51 is received in the compartment 22. The switch button 52 is mounted to the operative portion 23. The control member 51 includes a first transmission portion 511. The switch button 52 includes a second transmission portion 521. The first transmission portion 511 and the second transmission portion 521 are coupled to each other by extending through the through-hole 231. The switch button 52 is operable to actuate the control member 51 to cause joint pivotal movement of the switch button 52 and the control member 51 about the pivotal axis S. In this embodiment, the first transmission portion 511 includes a transmission hole 512, and the second transmission portion 521 includes a transmission rod 522 extending through the through-hole 231 into the transmission hole 512.

An end of the control member 51 presses against the first pawl 41 and the second pawl 42 when the reversible ratchet wrench is switched between a first position and a second position. The control member 51 includes at least one control arm 513 located adjacent to the ratcheting device 40. In this embodiment, there are two control arms 513, with each control arm 513 extending in a radial direction perpendicular to the pivotal axis S and with each control arm 513 having a sliding groove 514 extending in the radial direction perpendicular to the pivotal axis S.

The first protrusion 414 and the second protrusions 424 are received in the two sliding grooves 54. Each of the first pawl 41 and the second pawl 42 is slideable relative to the control member 51 in the radial direction perpendicular to the pivotal axis S. Furthermore, the first pawl 41 and the second pawl 42 are pivotable relative to the control member 51. Each sliding groove 514 includes two lateral sides, with each lateral side having an abutment face 515. The abutment faces 515 of each sliding groove 514 are located on two sides of one of the first protrusion 414 and the second protrusion 424.

The switch button 52 includes a bottom side having first and second positioning grooves 523 and 524 and facing the side of the body 20. The positioning member 234 is biased by the elastic element 233 to selectively engage with one of the first and second positioning grooves 523 and 524.

The push device 60 is mounted between the ratcheting device 40 and the switching device 50. The push device 60 includes first and second elastic elements 61 and 62 respectively received in the two sliding grooves 514. The first elastic element 61 has two ends respectively abutting the control member 51 and the first protrusion 414 of the first pawl 41. The second elastic element 62 has two ends respectively abutting the control member 51 and the second protrusion 424 of the second pawl 42. The first elastic element 61 biases the first pawl 41 away from the control member 51 to mesh with the annular toothed portion 31. The second elastic element 62 biases the second pawl 42 away from the control member 51 to mesh with the annular toothed portion 31.

With reference to FIGS. 6-9, the reversible ratchet wrench 10 can be switched between the first position and the second position. When the reversible ratchet wrench 10 in the first position; namely, when the switch button 52 is pivoted to the first position, the control member 51 pivots jointly to the first position, and the positioning member 234 is engaged in the first positioning groove 523. The control member 51 presses against and directly actuates the first pawl 41 and the second pawl 42 to the first position. When the first and second pawls 41 and 42 are in the first position, the first ratchet teeth 412 or the third ratchet teeth 422 mesh with the annular toothed portion 31, such that the first pawl 41 and the second pawl 42 are alternatively disposed. Thus, when the driving member 30 rotates in a non-driving direction, the driving member 30 pushes the first pawl 41 or the second pawl 42 away from the driving member 30, such that the first pawl 41 and the second pawl 42 mesh with the annular toothed portion 31 in turn.

Figure 10:
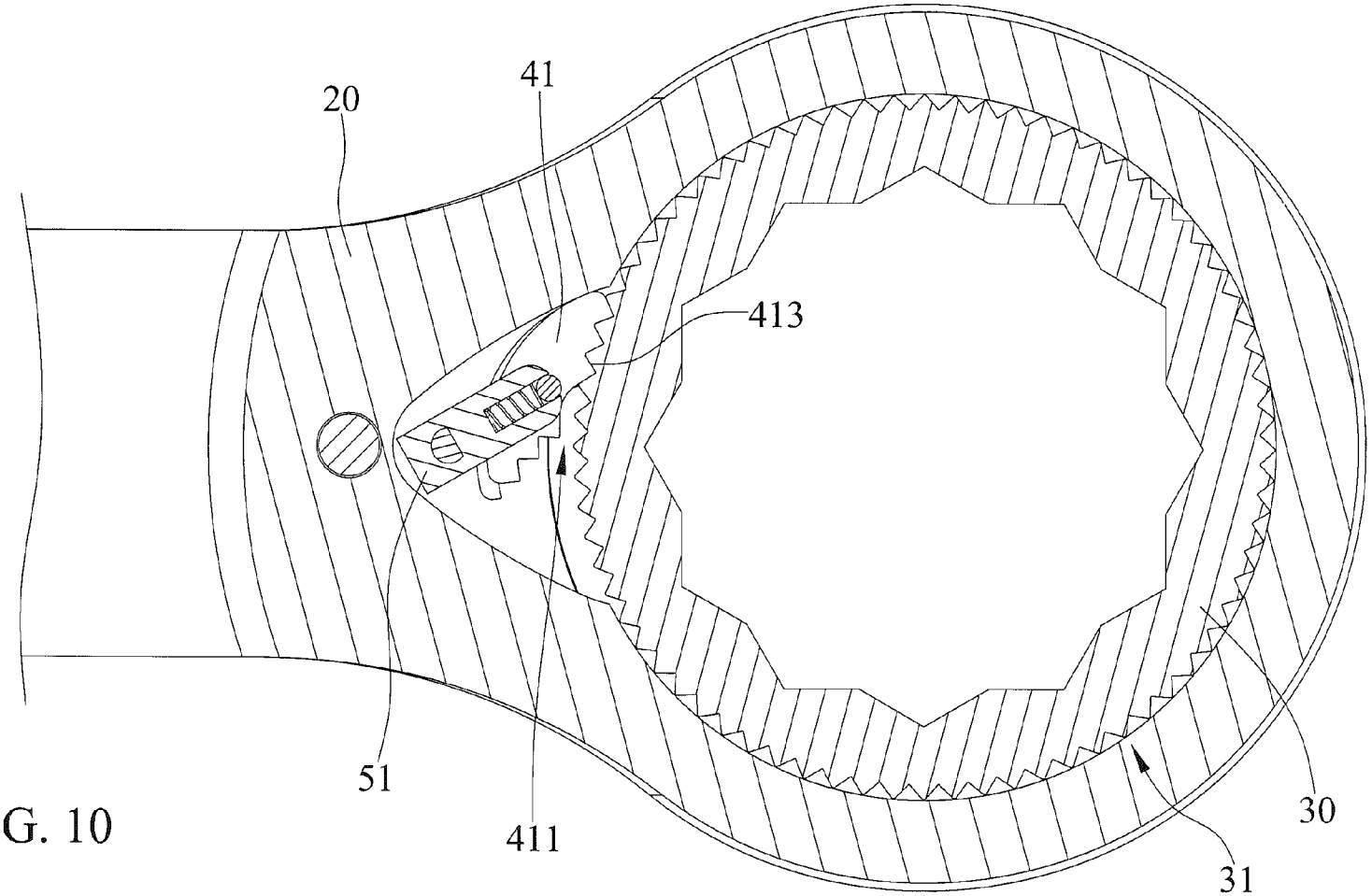
FIG. 10 is a view similar to FIG. 6 with the first pawl pivoted to a second position.
Figure 11:
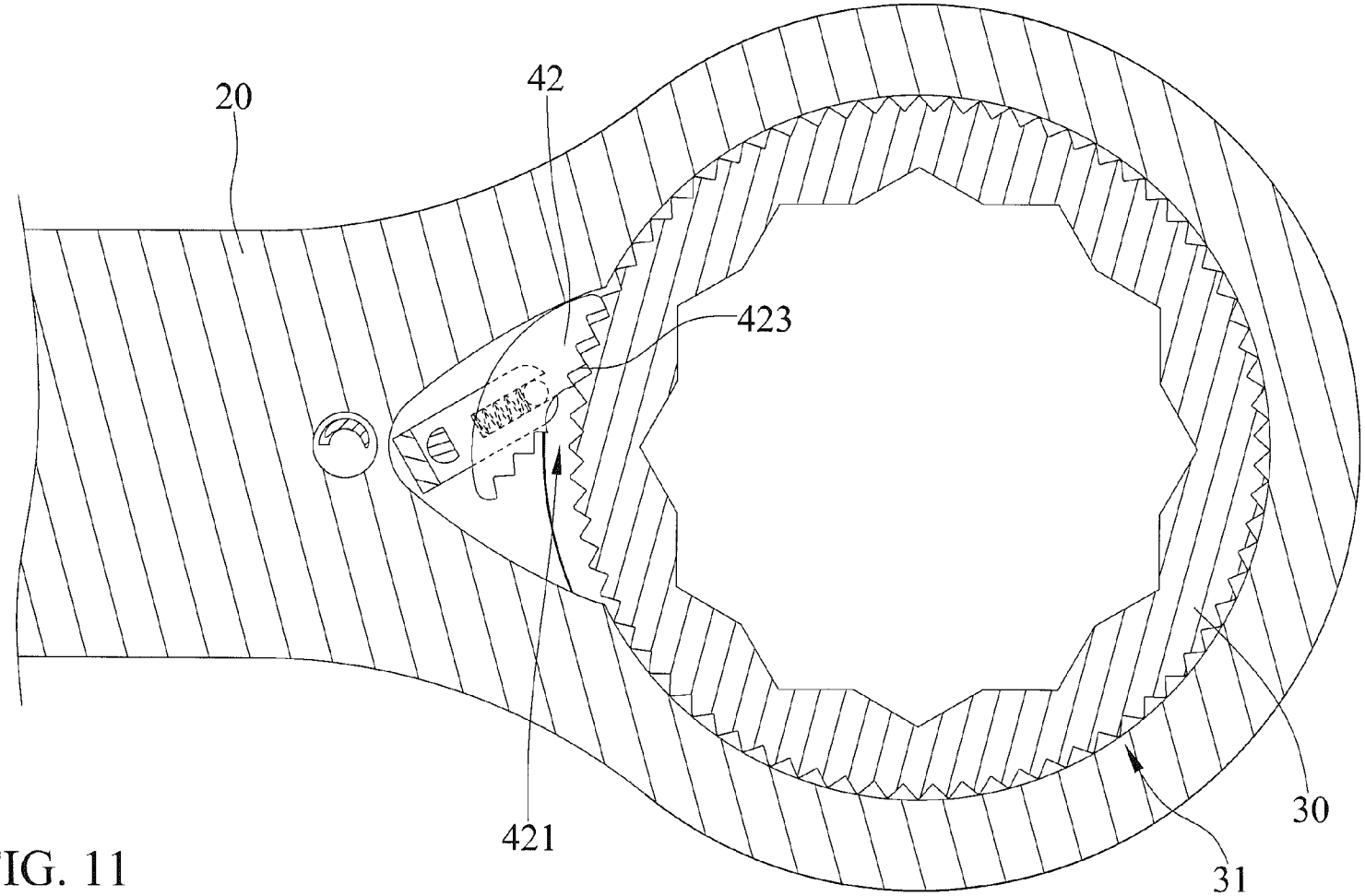
FIG. 11 is a view similar to FIG. 7 with the second pawl pivoted to a second position.
Figure 12:
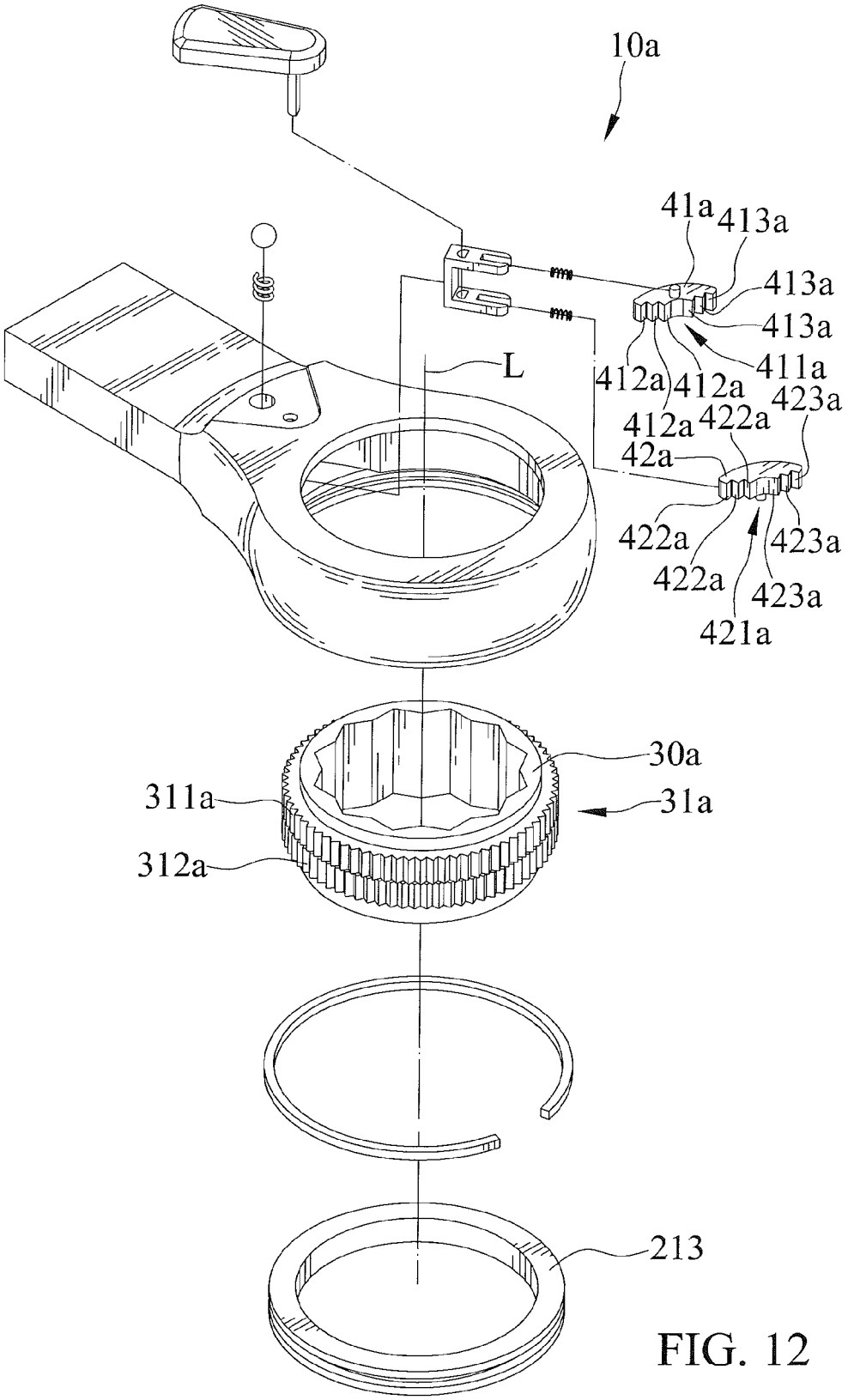
FIG. 12 is an exploded, perspective view of a reversible ratchet wrench with a smaller rotational angle of a second embodiment according to the present invention.
Figure 13:
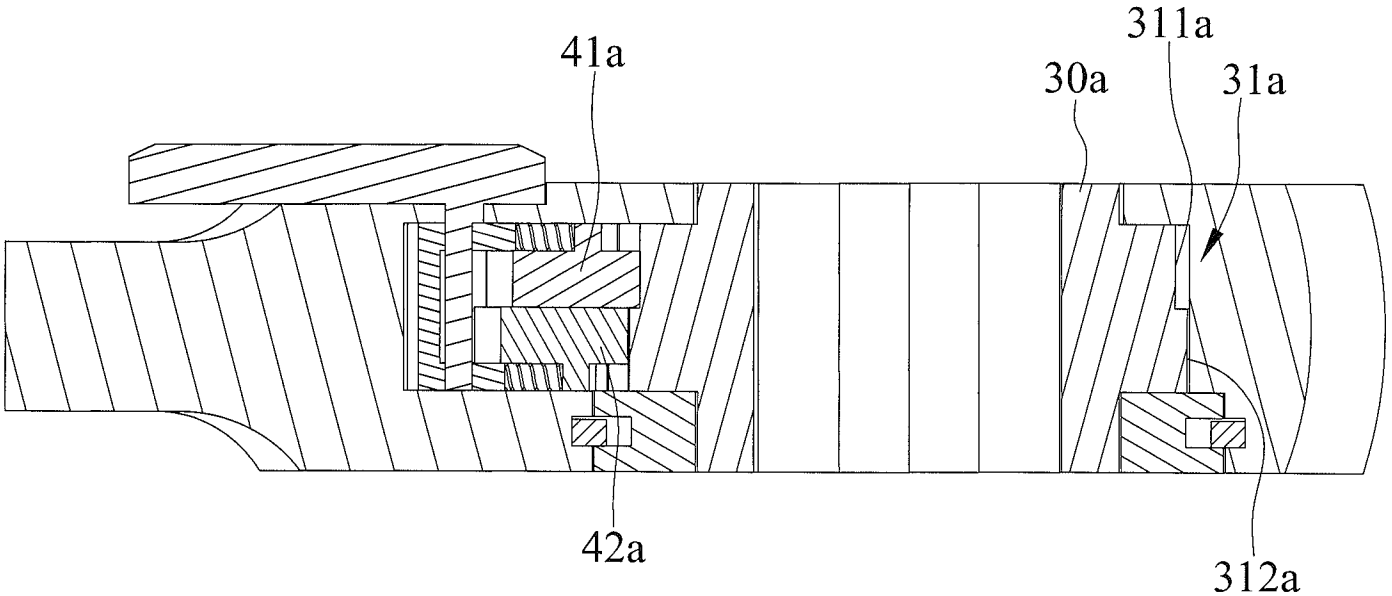
FIG. 13 is a cross sectional view of the reversible ratchet wrench of FIG. 12.
Figure 14:
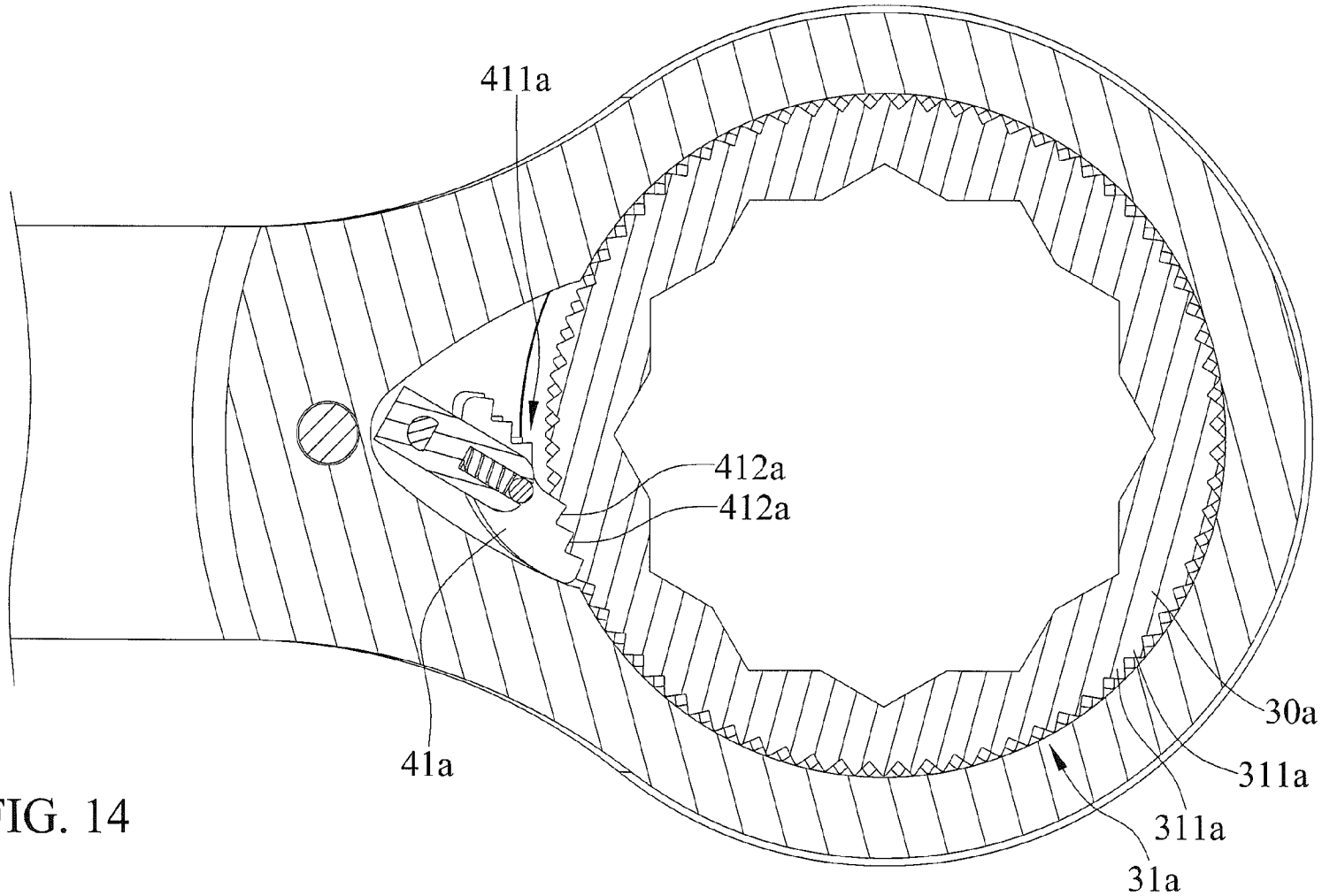
FIG. 14 is another cross sectional view of the reversible ratchet wrench of FIG. 12, illustrating a first pawl in a first position.
Figure 15:
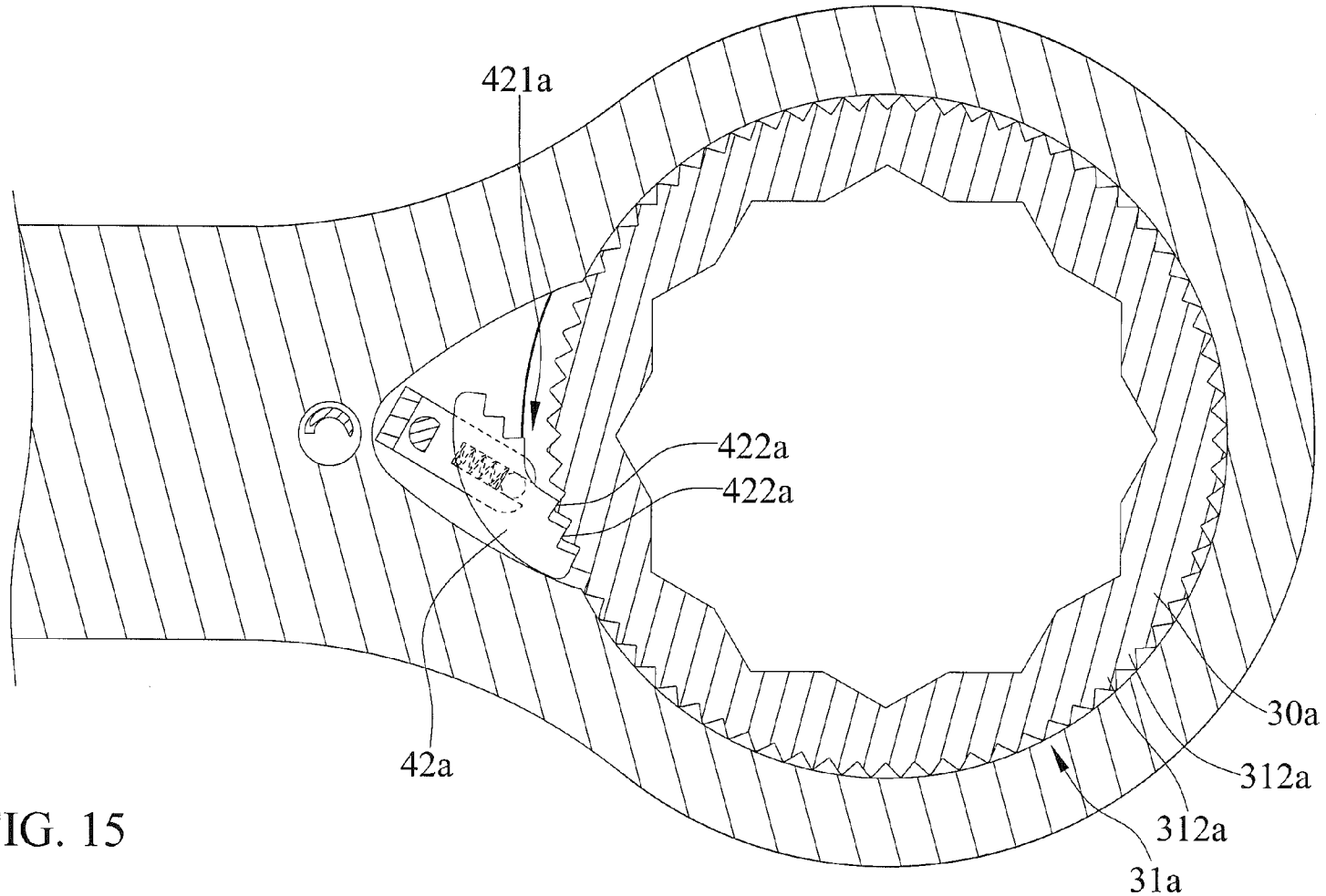
FIG. 15 is a further cross sectional view of the reversible ratchet wrench of FIG. 12, illustrating a second pawl in a first position.
Figure 16:
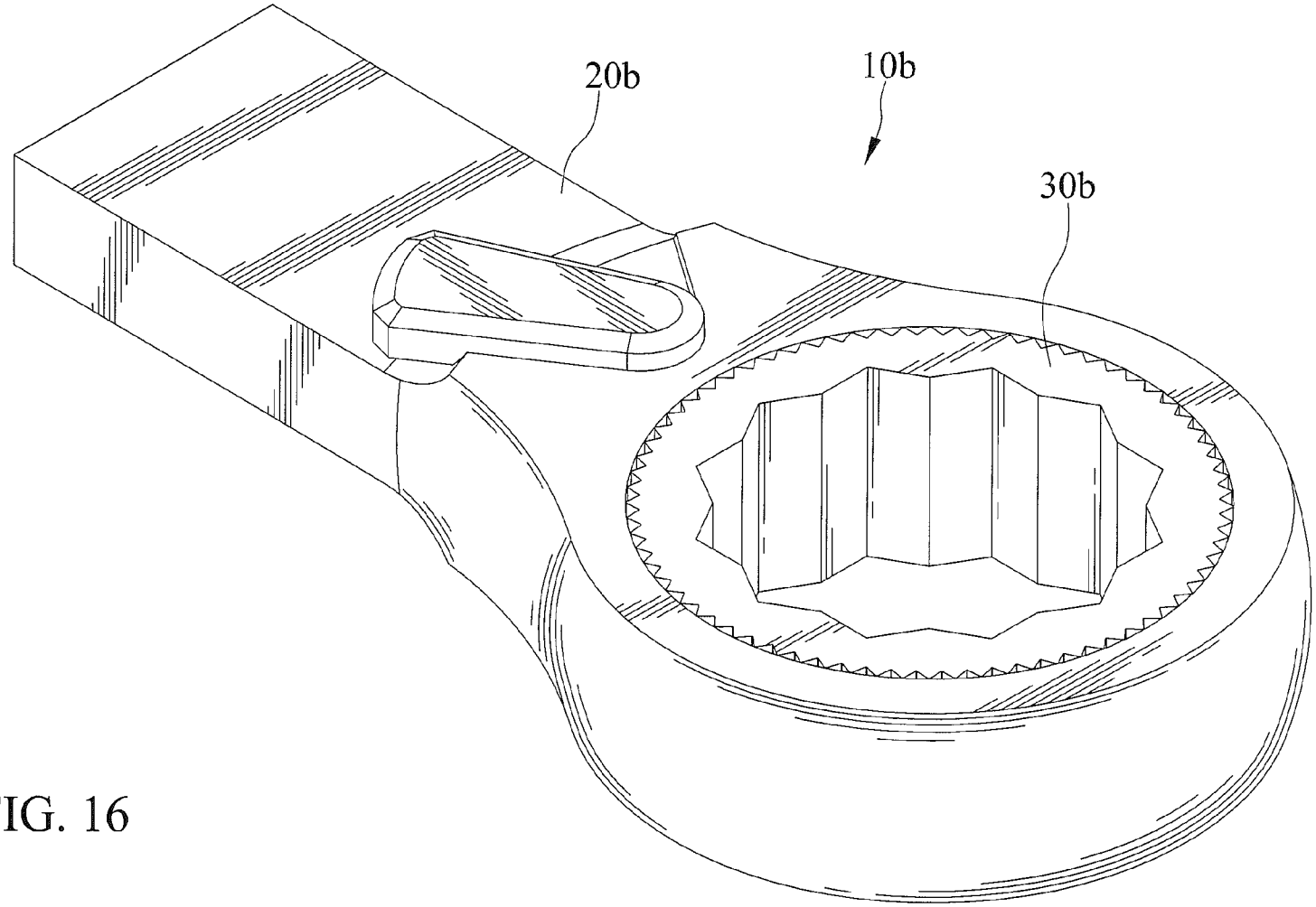
FIG. 16 is a perspective view of a reversible ratchet wrench with a smaller rotational angle of a third embodiment according to the present invention.
Figure 17:
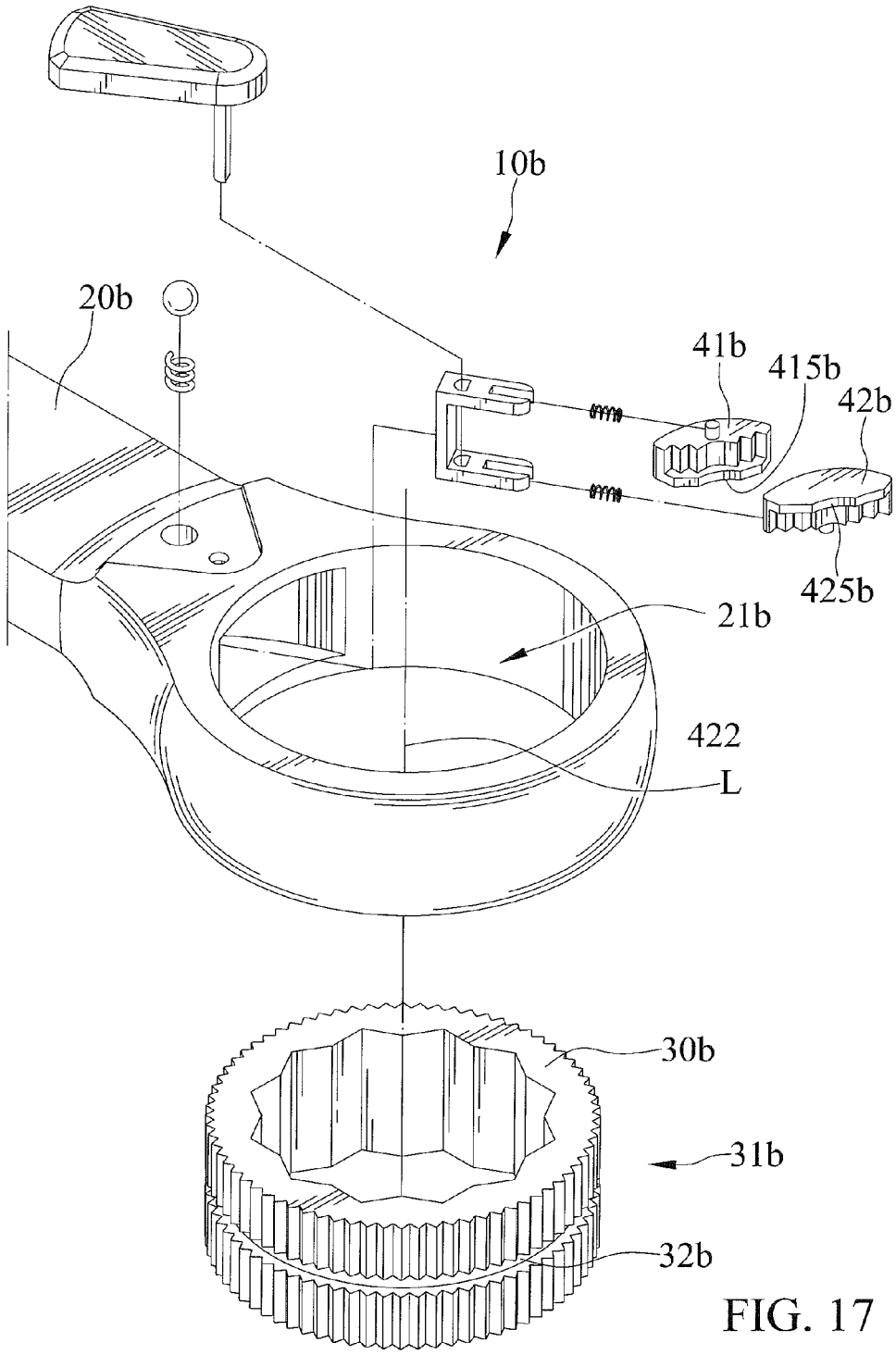
FIG. 17 is an exploded, perspective view of the reversible ratchet wrench of FIG. 16.
Figure 18:
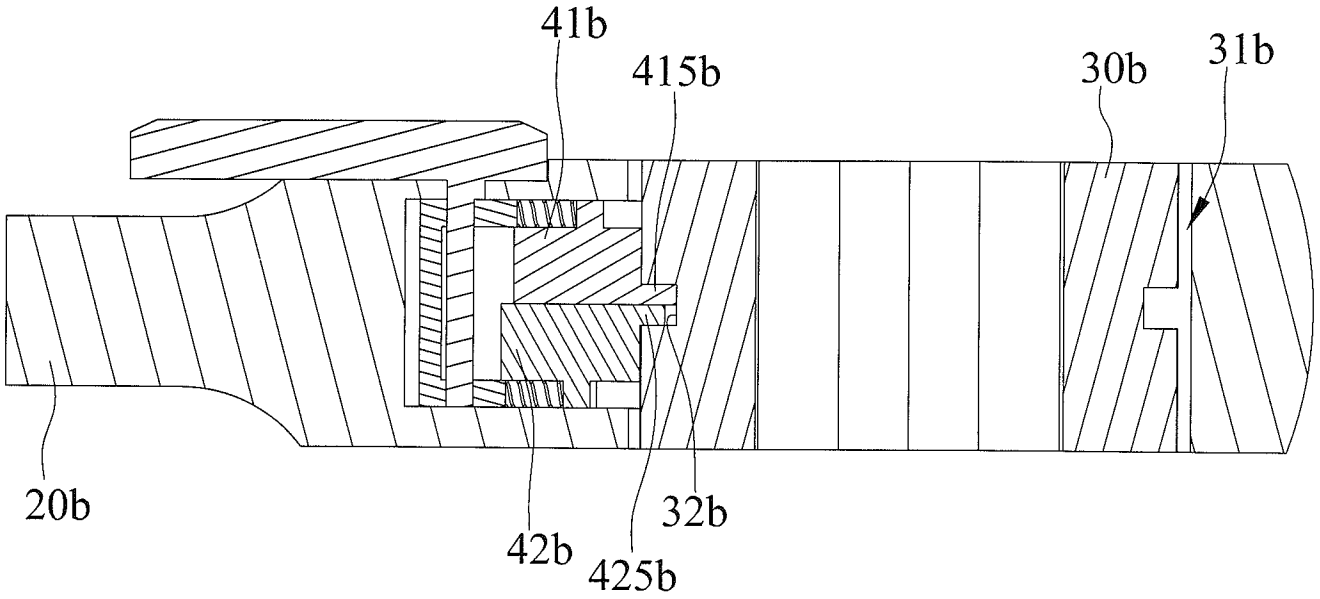
FIG. 18 is a cross sectional view of the reversible ratchet wrench of FIG. 16.
Figure 19:
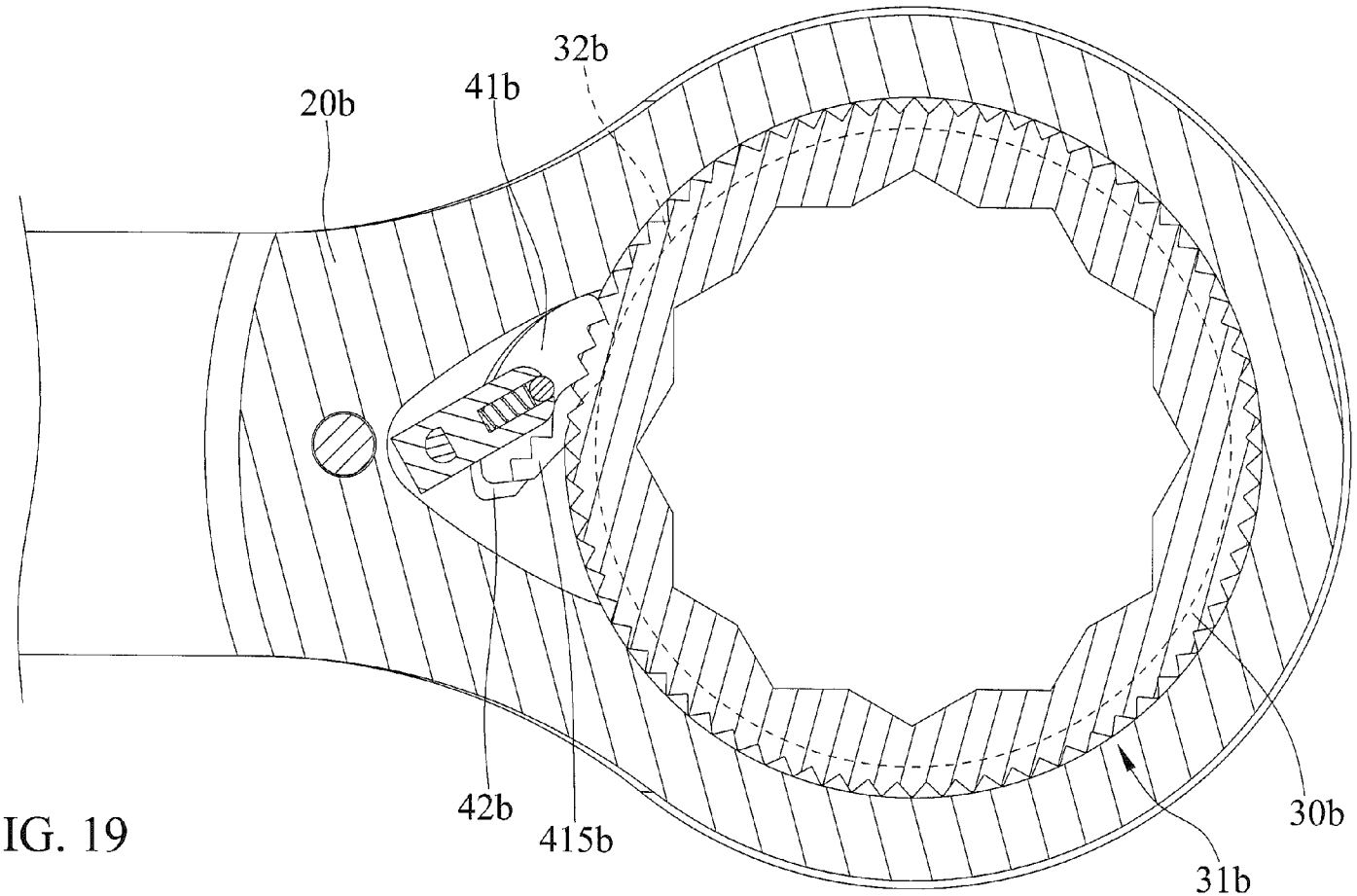
FIG. 19 is another cross sectional view of the reversible ratchet wrench of FIG. 16.
Figure 20:
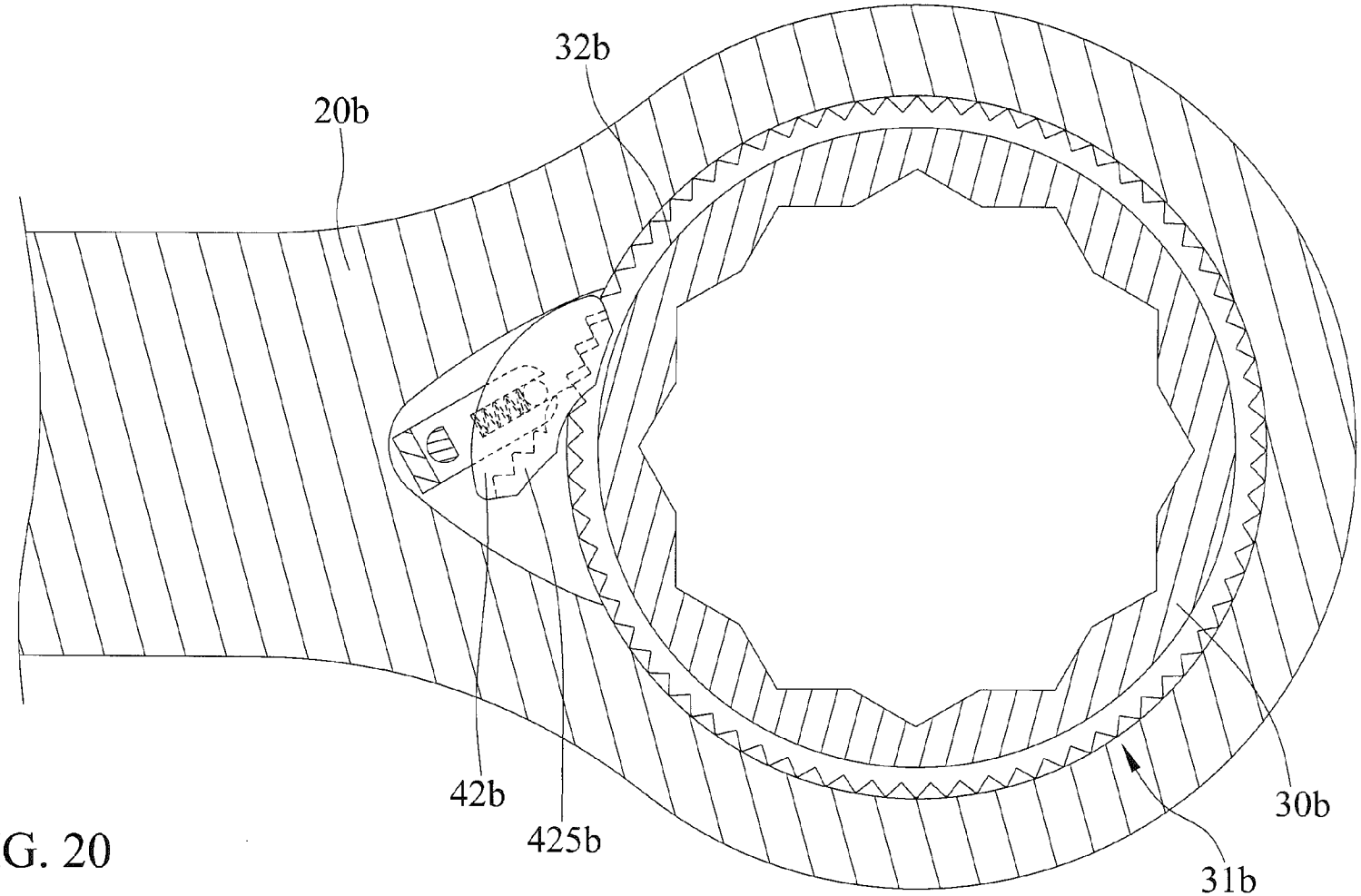
FIG. 20 is a further cross sectional view of the reversible ratchet wrench of FIG. 16.
Figure 21:
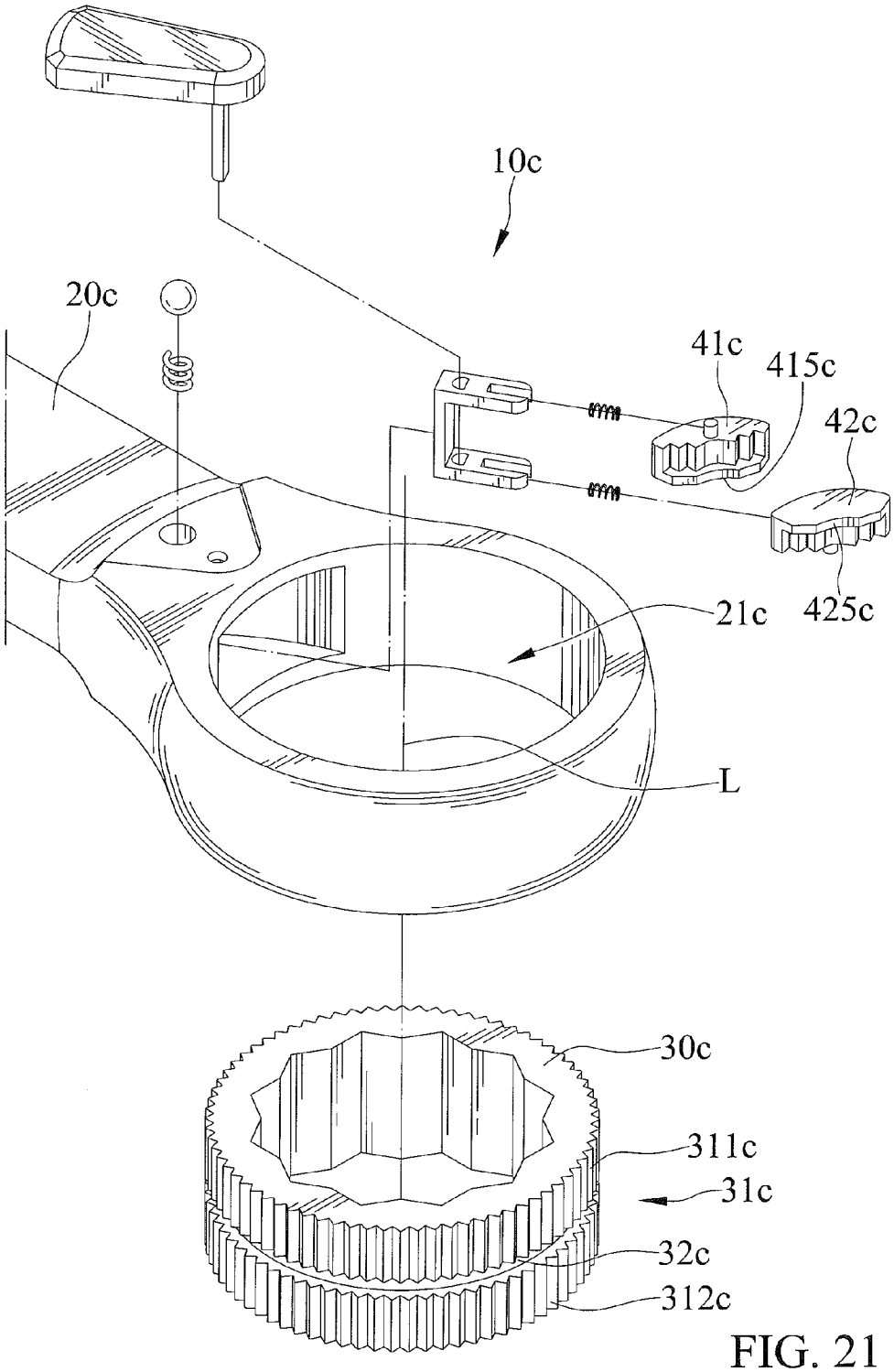
FIG. 21 is an exploded, perspective view of a reversible ratchet wrench with a smaller rotational angle of a fourth embodiment according to the present invention.
Figure 22:
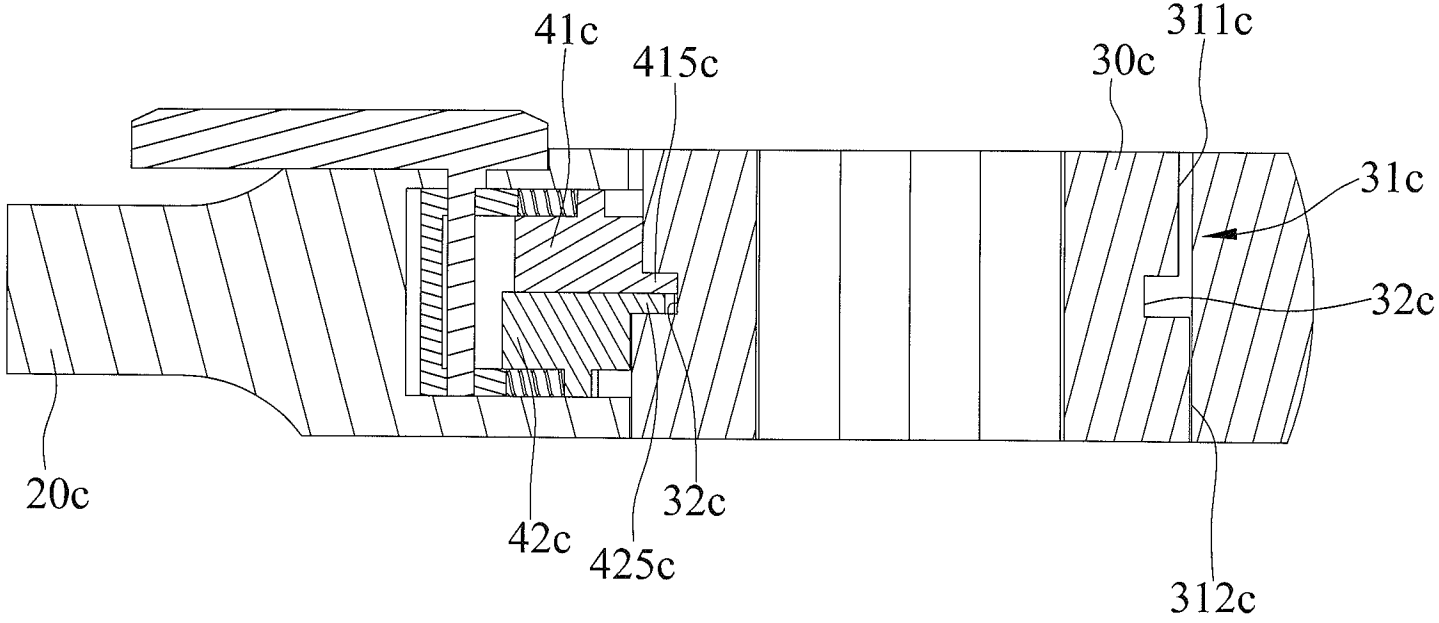
FIG. 22 is a cross sectional view of the reversible ratchet wrench of FIG. 21.
Figure 23:
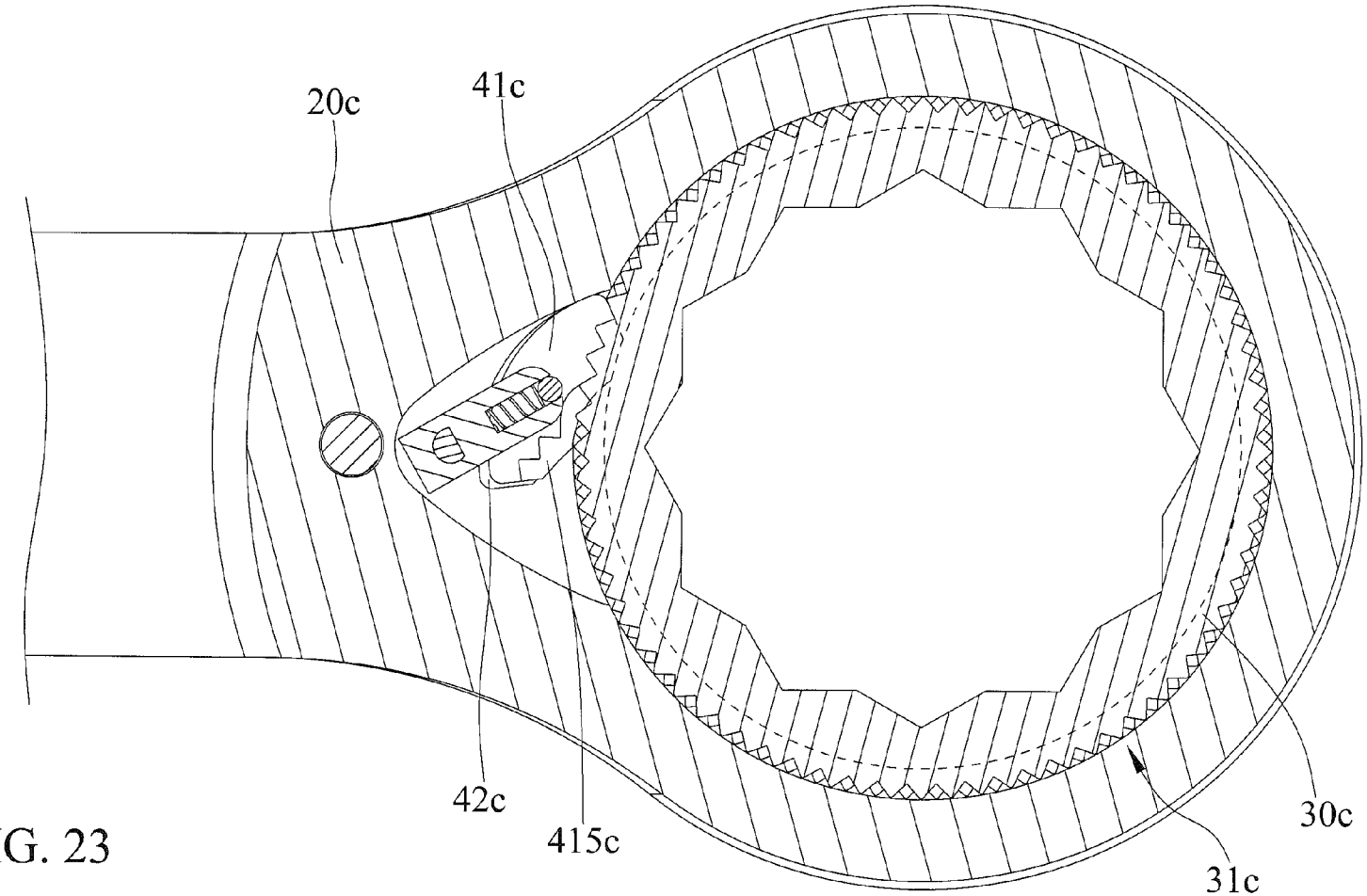
FIG. 23 is another cross sectional view of the reversible ratchet wrench of FIG. 21.
Figure 24:
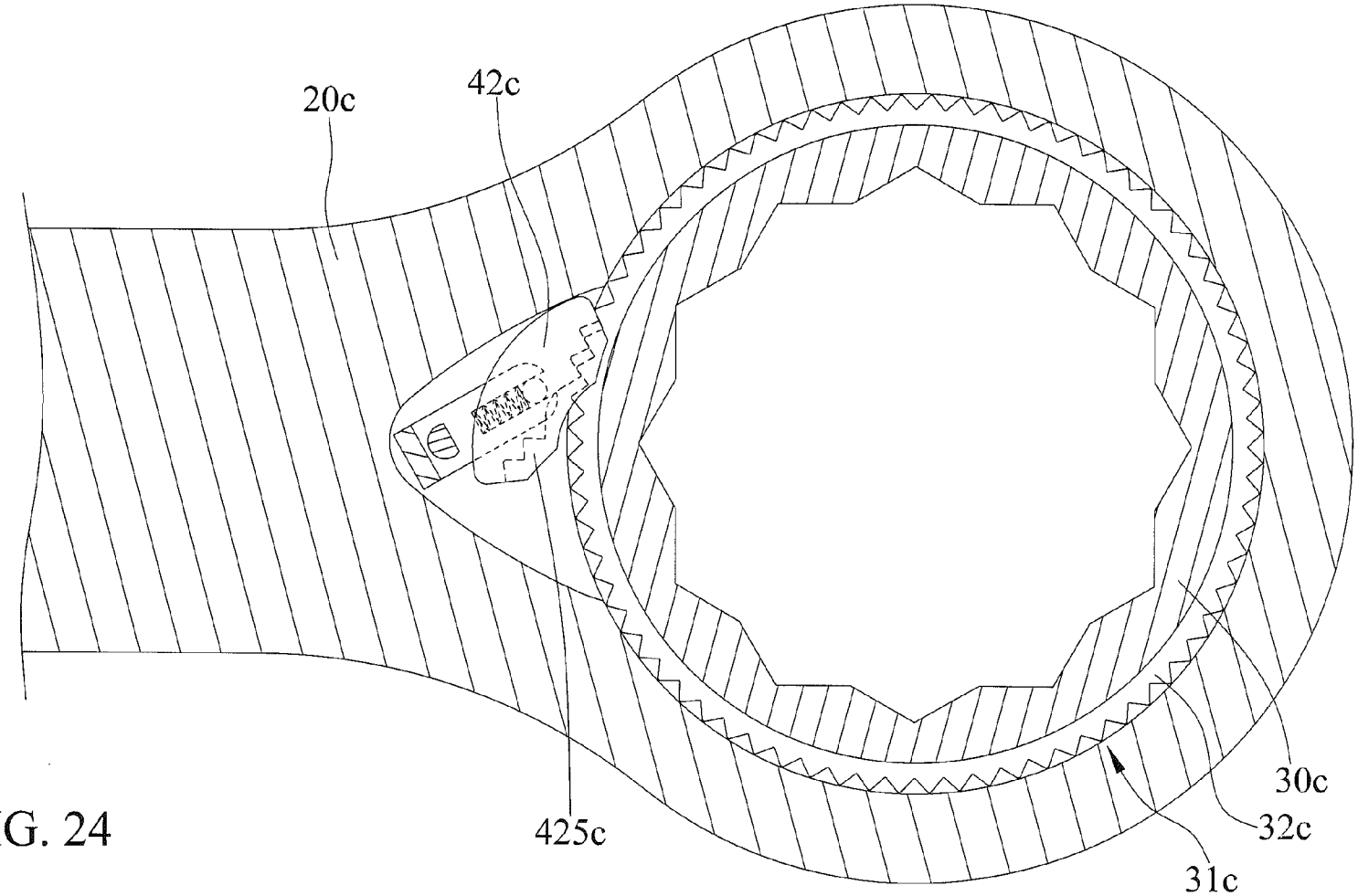
FIG. 24 is a further cross sectional view of the reversible ratchet wrench of FIG. 21.

With reference to FIGS. 10 and 11, when the reversible ratchet wrench 10 is in the second position; namely, when the switch button 52 is pivoted to the second position, the control member 51 pivots jointly to the second position, and the positioning member 234 is engaged in the second positioning groove 524. The control member 51 presses against and directly actuates the first pawl 41 and the second pawl 42 to the second position. When the first and second pawls 41 and 42 are in the second position, the second ratchet teeth 413 or the fourth ratchet teeth 423 mesh with the annular toothed portion 31, such that the first pawl 41 and the second pawl 42 are alternatively disposed.

Since only one of the first pawl 41 and the second pawl 42 meshes with the annular toothed portion 31 when the ratcheting device 40 meshes with the driving member 30, the reversible ratchet wrench 10 can move through an angle that is only a half of the angle between two adjacent teeth of the annular toothed portion 31. Thus, the reversible ratchet wrench 10 can operate in a limited space by a smaller rotational angle.

Since the first pawl 41 and the second pawl 42 of the ratcheting device 40 can directly be moved by the control member 51 of the switching device 50, the first pawl 41 and the second pawl 42 can reliably be moved when the reversible ratchet wrench 10 is switched between the first and second positions, assuring smooth switching operation. Furthermore, the pivotal axis S is distant to the first and second pawls 41 and 42 such that the first and second pawls 41 and 42 are moved through a larger angle when the control member 51 pivots. Thus, the first and second pawls 41 and 42 can mesh with the driving member 30 with an optimal angle to provide the maximal torque output. Furthermore, the first and second pawls 41 and 42 can pivot relative to the control member 51 during the switching operation of the reversible ratchet wrench 10. Thus, the first and second pawls 41 and 42 can change their angular positions at any time when the first and second pawls 41 and 42 are actuated by the control member 51, avoiding the first and second pawls 41 and 42 from still meshing with the driving member 30 and, hence, avoiding unsmooth switching.

FIGS. 12-15 show a reversible ratchet wrench 10*a* with a smaller rotational angle of a second embodiment according to the present invention. The second embodiment is substantially the same as the first embodiment. The main differences between the second embodiment and the first embodiment are that the annular toothed portion 31*a* of the driving member 30 includes a plurality of annularly arranged first teeth 311*a* and a plurality of annularly arranged second teeth 312*a*. The annularly arranged first teeth 311*a* and the annularly arranged second teeth 312*a* are aligned with each other along the rotational axis C and are alternatively disposed. The first and second pawls 41*a* and 42*a* have an identical shape in this embodiment. The first ratchet teeth 412*a* or the second ratchet teeth 413*a* of the first ratcheting portion 411*a* selectively mesh with the annularly arranged first teeth 311*a*, and the third ratchet teeth 422*a* or the fourth ratchet teeth 423*a* of the second ratcheting portion 421*a* selectively mesh with the annularly arranged second teeth 312*a*. Thus, the first and second pawls 41*a* and 42*a* are alternatively disposed.

The reversible ratchet wrench 10*a* can be switched between the first and second positions. When the first and second pawls 41*a* and 42*a* are in the first position, the first ratchet teeth 412*a* or the third ratchet teeth 422*a* mesh with the annular toothed portion 31*a* such that the first and second pawls 41*a* and 42*a* are alternatively disposed. On the other hand, when the first and second pawls 41*a* and 42*a* are in the second position, the second ratchet teeth 413*a* or the fourth ratchet teeth 423*a* mesh with the annular toothed portion 31*a* such that the first and second pawls 41*a* and 42*a* are alternatively disposed.

Since the first and second pawls 41*a* and 42*a* have an identical shape in this embodiment, the first and second pawls 41*a* and 42*a* can be processed by the same process to reduce the manufacturing costs of the reversible ratchet wrench 10*a*.

FIGS. 16-20 show a reversible ratchet wrench 10*b* with a smaller rotational angle of a third embodiment according to the present invention. The third embodiment is substantially the same as the first embodiment. The main differences between the third embodiment and the first embodiment are that the receiving space 21*b* extends from a side through the other side of the body 20*b* and is in the form of a cylindrical hole. Furthermore, the driving member 30*b* includes an annular groove 32*b* defined in the annular toothed portion 31*b*. The first pawl 41*b* includes a first engagement ledge 415*b* extending towards the driving member 30*b*. The second pawl 42*b* includes a second engagement ledge 425*b* extending towards the driving member 30*b*. The first and second engagement ledges 415*b* and 425*b* are received in the annular groove 32*b*. The annular groove 32*b* is located between the first pawl 41*b* and the second pawl 42*b*. Thus, the first pawl 41*b* and the second pawl 42*b* respectively mesh with two sides of the annular toothed portion 31*b*. The first engagement ledge 415*b* is formed on a surface of the first pawl 41*b* adjacent to the second pawl 42*b*. The second engagement ledge 425*b* is formed on a surface of the second pawl 42*b* adjacent to the first pawl 41*b*.

Since the first and second engagement ledges 415*b* and 425*b* are directly received in the annular groove 32*b* of the driving member 30*b*, disengagement of the driving member 30*b* from the receiving space 21*b* is avoided. Thus, the receiving space 21*b* can be processed by directly extending through two sides of the body 20*b*, effectively simplifying the structure of the reversible ratchet wrench 10*b* and reducing the manufacturing costs of the reversible ratchet wrench 10*b*.

FIGS. 21-24 show a reversible ratchet wrench 10*c* with a smaller rotational angle of a fourth embodiment according to the present invention. The fourth embodiment is substantially the same as the second embodiment. The main differences are that the receiving space 21*c* extends from a side through the other side of the body 20*c* and is in the form of a cylindrical hole. Furthermore, the driving member 30*c* includes an annular groove 32*c* defined in the annular toothed portion 31*c*. The first pawl 41*c* includes a first engagement ledge 415*c* extending towards the driving member 30*c*. The second pawl 42*c* includes a second engagement ledge 425*c* extending towards the driving member 30*c*. The first and second engagement ledges 415*c* and 425*c* are received in the annular groove 32*c*. The annular groove 32*c* is located between the first pawl 41*c* and the second pawl 42*c*. Thus, the first pawl 41*c* and the second pawl 42*c* respectively mesh with two sides of the annular toothed portion 31*c*. The first engagement ledge 415*c* is formed on a surface of the first pawl 41*c* adjacent to the second pawl 42*c*. The second engagement ledge 425*c* is formed on a surface of the second pawl 42*c* adjacent to the first pawl 41*c*.

Since the first and second engagement ledges 415*c* and 425*c* are directly received in the annular groove 32*c* of the driving member 30*c*, disengagement of the driving member 30*c* from the receiving space 21*c* is avoided. Thus, the receiving space 21*c* can be processed by directly extending through two sides of the body 20*c*, effectively simplifying the structure of the reversible ratchet wrench 10*c* and reducing the manufacturing costs of the reversible ratchet wrench 10*c*.

In view of the foregoing, the present invention has the following advantages:

1. The first pawl 41, 41*a*, 41*b*, 41*c* and the second pawl 42, 42*a*, 42*b*, 42*c* of the ratcheting device 40 are directly actuated by the control member 51 of the switching device 50 and, thus, can reliably be moved during switching of the reversible ratchet wrench 10, 10*a*, 10*b*, 10*c* between the first and second positions, assuring smooth switching of the reversible ratchet wrench 10, 10*a*, 10*b*, 10*c*.

2. The first pawl 41, 41*a*, 41*b*, 41*c* and the second pawl 42, 42*a*, 42*b*, 42*c* can pivot relative to the control member 51 during the switching operation of the reversible ratchet wrench 10, 10*a*, 10*b*, 10*c*. Thus, the first pawl 41, 41*a*, 41*b*, 41*c* and the second pawl 42, 42*a*, 42*b*, 42*c* can change their angular positions at any time when the first pawl 41, 41*a*, 41*b*, 41*c* and the second pawl 42, 42*a*, 42*b*, 42*c* are actuated by the control member 51, avoiding the first pawl 41, 41*a*, 41*b*, 41*c* and the second pawl 42, 42*a*, 42*b*, 42*c* from still meshing with the driving member 30, 31*a*, 31*b*, 31*c* and, hence, avoiding unsmooth switching.

Although preferred embodiments of the present invention have been illustrated and described, they should not be construed to restrict the scope of the present invention. Therefore, modifications to numerical values or substitution of equivalent elements thereof or equivalent changes and modifications based on the accompanying claims of the present invention still fall within the scope covered by the present invention.

The invention claimed is:

1. A reversible ratchet wrench with a smaller rotational angle comprising:

a body defining a rotational axis, with the body including a receiving space and a compartment intercommunicated with the receiving space, with the compartment located on a side of the receiving space in a radial direction perpendicular to the rotational axis;

a driving member received in the receiving space of the body, with the driving member rotatable about the rotational axis relative to the body, with the driving member including an annular toothed portion surrounding the rotational axis;

a ratcheting device including a first pawl and a second pawl, with the first pawl and the second pawl aligned with each other along an axis parallel to the rotational axis and alternatively disposed, with the first pawl and the second pawl received in the compartment, with one of the first pawl and the second pawl selectively meshed with the driving member, with the first pawl including a side facing the driving member and having a first ratcheting portion, with the second pawl including a side facing the driving member and having a second ratcheting portion, with the first ratcheting portion and the second ratcheting portion selectively meshed with the annular toothed portion of the driving member;

a switching device defining a pivotal axis parallel to the rotational axis, with the pivotal axis spaced from the first pawl and the second pawl, with the switching device including a control member received in the compartment and pivotable about the pivotal axis, with an end of the control member pressing against the first pawl and the second pawl when the reversible ratchet wrench is switched between a first position and a second position, with the control member capable of moving the first pawl and the second pawl; and a push device mounted between the ratcheting device and the switching device, with the push device biasing the first pawl and the second pawl to mesh with the annular toothed portion;

with the first pawl including a first protrusion extending along the axis parallel to the rotational axis, with the second pawl including a second protrusion extending along the axis parallel to the rotational axis, with the control member including at least one control arm located adjacent to the ratcheting device, with the at least one control arm extending in a radial direction perpendicular to the pivotal axis, with the at least one control arm including a sliding groove extending in the radial direction perpendicular to the pivotal axis, with the first protrusion received in the sliding groove, with the first pawl slideable relative to the control member in the radial direction perpendicular to the pivotal axis, and with the first pawl pivotable relative to the control member.

2. The reversible ratchet wrench according to claim 1, with the at least one control arm including two control arms, with each of the two control arms including the sliding groove, with the first protrusion located on a surface of the first pawl distant to the second pawl, with the second protrusion located on a surface of the second pawl distant to the first pawl, with the first protrusion and the second protrusion respectively and slideably received in the sliding grooves of the two control arms, with the second pawl slideable relative to the control member in the radial direction perpendicular to the pivotal axis, with the second pawl pivotable relative to the control member, with each sliding groove including two lateral sides, with each of the two lateral sides having an abutment face, and with the abutment faces of each sliding groove located on two sides of one of the first protrusion and the second protrusion.

3. The reversible ratchet wrench according to claim 2, wherein each of the first protrusion and the second protrusion is cylindrical.

4. The reversible ratchet wrench according to claim 3, with the push device including first and second elastic elements respectively received in the sliding grooves, with the first elastic element having two ends respectively abutting the control member and the first protrusion of the first pawl, with the second elastic element having two ends respectively abutting the control member and the second protrusion of the second pawl, with the first elastic element biasing the first pawl away from the control member, and with the second elastic element biasing the second pawl away from the control member.

5. The reversible ratchet wrench according to claim 1, with the first ratcheting portion having a plurality of first ratchet teeth and a plurality of second ratchet teeth respectively on two ends of the first ratcheting portion, with the plurality of first ratchet teeth and the plurality of second ratchet teeth not located on a same plane, with the second ratcheting portion having a plurality of third ratchet teeth and a plurality of fourth ratchet teeth respectively on two ends of the second ratcheting portion, with the plurality of third ratchet teeth and the plurality of fourth ratchet teeth not located on a same plane, wherein the plurality of first ratchet teeth or the plurality of third ratchet teeth meshes with the annular toothed portion when the first pawl and the second pawl are in the first position, and wherein the plurality of second ratchet teeth or the plurality of fourth ratchet teeth meshes with the annular toothed portion when the first pawl and the second pawl are in the second position.

6. The reversible ratchet wrench according to claim 1, with the annular toothed portion including a plurality of annularly arranged first teeth and a plurality of annularly arranged second teeth, with the plurality of annularly arranged first teeth and the plurality of annularly arranged second teeth aligned with each other along the rotational axis and alternatively disposed, with the first pawl and the second pawl having an identical shape, with the plurality of first ratchet teeth or the plurality of second ratchet teeth of the first ratcheting portion selectively meshed with the plurality of annularly arranged first teeth, and with the plurality of third ratchet teeth or the plurality of fourth ratchet teeth of the second ratcheting portion selectively meshed with the plurality of annularly arranged second teeth.

7. The reversible ratchet wrench according to claim 6, with the driving member further including an annular groove defined between the plurality of annularly arranged first teeth and the plurality of annularly arranged second teeth, with the first pawl including a first engagement ledge extending towards the driving member, and with the first engagement ledge received in the annular groove.

8. The reversible ratchet wrench according to claim 7, with the second pawl including a second engagement ledge extending towards the driving member, with the second engagement ledge received in the annular groove, with the first pawl meshed with the plurality of annularly arranged first teeth, with the second pawl meshed with the plurality of annularly arranged second teeth, with the first engagement ledge formed on another surface of the first pawl adjacent to the second pawl, and with the second engagement ledge formed on another surface of the second pawl adjacent to the first pawl.

9. The reversible ratchet wrench according to claim 1, with the body further including an operative portion having a through-hole, with the through-hole extending along a first axis coaxial to the pivotal axis and intercommunicating the compartment with an outside, with the switching device further including a switch button mounted to the operative portion, with the control member including a first transmission portion, with the switch button including a second transmission portion, with the first transmission portion and the second transmission portion coupled to each other by extending through the through-hole, and with the switch button operable to actuate the control member to cause joint pivotal movement of the switch button and the control member about the pivotal axis.

10. The reversible ratchet wrench according to claim 9, with the first transmission portion including a transmission hole, and with the second transmission portion including a transmission rod extending through the through-hole into the transmission hole.

11. The reversible ratchet wrench according to claim 9, with the operative portion further including a receptacle, an elastic element, and a positioning member, with the receptacle defined in a side of the body and extending along a second axis parallel to the longitudinal axis, with the first axis located between the second axis and the longitudinal axis, with the elastic element and the positioning member received in the receptacle, with the elastic element including two ends respectively abutting an end wall of the receptacle and the positioning member, with the switch button including a bottom side having first and second positioning grooves and facing the side of the body, and with the positioning member biased by the elastic element to selectively engage with one of the first and second positioning grooves.

12. A reversible ratchet wrench with a smaller rotational angle comprising:

a body defining a rotational axis, with the body including a receiving space and a compartment intercommunicated with the receiving space, with the compartment located on a side of the receiving space in a radial direction perpendicular to the rotational axis;

a driving member received in the receiving space of the body, with the driving member rotatable about the rotational axis relative to the body, with the driving member including an annular toothed portion surrounding the rotational axis;

a ratcheting device including a first pawl and a second pawl, with the first pawl and the second pawl aligned with each other along an axis parallel to the rotational axis and alternatively disposed, with the first pawl and the second pawl received in the compartment, with one of the first pawl and the second pawl selectively meshed with the driving member, with the first pawl including a side facing the driving member and having a first ratcheting portion, with the second pawl including a side facing the driving member and having a second ratcheting portion, with the first ratcheting portion and the second ratcheting portion selectively meshed with the annular toothed portion of the driving member;

a switching device defining a pivotal axis parallel to the rotational axis, with the pivotal axis spaced from the first pawl and the second pawl, with the switching device including a control member received in the compartment and pivotable about the pivotal axis, with an end of the control member pressing against the first pawl and the second pawl when the reversible ratchet wrench is switched between a first position and a second position, with the control member capable of moving the first pawl and the second pawl; and a push device mounted between the ratcheting device and the switching device, with the push device biasing the first pawl and the second pawl to mesh with the annular toothed portion;

with the driving member further including an annular groove defined in the annular toothed portion, with the first pawl including a first engagement ledge extending towards the driving member, and with the first engagement ledge received in the annular groove.

13. The reversible ratchet wrench according to claim 12, with the second pawl including a second engagement ledge extending towards the driving member, with the second engagement ledge received in the annular groove, with the annular groove located between the first pawl and the second pawl, with the first pawl and the second pawl respectively meshed with two sides of the annular toothed portion, with the first engagement ledge formed on another surface of the first pawl adjacent to the second pawl, and with the second engagement ledge formed on another surface of the second pawl adjacent to the first pawl.

14. A reversible ratchet wrench with a smaller rotational angle comprising:

a body defining a rotational axis, with the body including a receiving space and a compartment intercommunicated with the receiving space, with the compartment located on a side of the receiving space in a radial direction perpendicular to the rotational axis;

a driving member received in the receiving space of the body, with the driving member rotatable about the rotational axis relative to the body, with the driving member including an annular toothed portion surrounding the rotational axis;

a ratcheting device including a first pawl and a second pawl, with the first pawl and the second pawl aligned with each other along an axis parallel to the rotational axis and alternatively disposed, with the first pawl and the second pawl received in the compartment, with one of the first pawl and the second pawl selectively meshed with the driving member, with the first pawl including a side facing the driving member and having a first ratcheting portion, with the second pawl including a side facing the driving member and having a second ratcheting portion, with the first ratcheting portion and the second ratcheting portion selectively meshed with the annular toothed portion of the driving member;

a switching device defining a pivotal axis parallel to the rotational axis, with the pivotal axis spaced from the first pawl and the second pawl, with the switching device including a control member received in the compartment and pivotable about the pivotal axis, with an end of the control member pressing against the first pawl and the second pawl when the reversible ratchet wrench is switched between a first position and a second position, with the control member capable of moving the first pawl and the second pawl; and a push device mounted between the ratcheting device and the switching device, with the push device biasing the first pawl and the second pawl to mesh with the annular toothed portion;

with the receiving space having a first diameter, with the body including a coupling ledge and a coupling groove in the receiving space, with the coupling ledge and the coupling groove located at two ends of the receiving space along the rotational axis, with a retainer ring received in the coupling groove, with the coupling ledge having a second diameter, with the retainer ring having a third diameter, with the second and third diameters smaller than the first diameter, with the annular toothed portion having a maximum diameter smaller than the first diameter and larger than the second and third diameters, and with the driving member including two sides respectively abutting the coupling ledge and the retainer ring.

* * * * *